US008758152B2

(12) United States Patent
Hall

(10) Patent No.: US 8,758,152 B2
(45) Date of Patent: Jun. 24, 2014

(54) SWING FEEDBACK DEVICE

(76) Inventor: Blair Christian Hall, Victoria (AU)

( * ) Notice: Subject to any disclaimer, the term of this patent is extended or adjusted under 35 U.S.C. 154(b) by 0 days.

(21) Appl. No.: 13/700,052

(22) PCT Filed: May 25, 2011

(86) PCT No.: PCT/AU2011/000626
§ 371 (c)(1),
(2), (4) Date: Dec. 6, 2012

(87) PCT Pub. No.: WO2011/146984
PCT Pub. Date: Dec. 1, 2011

(65) Prior Publication Data

US 2013/0085008 A1 Apr. 4, 2013

(30) Foreign Application Priority Data

May 25, 2010 (AU) ..... 2010902289

(51) Int. Cl.
*A63B 69/36* (2006.01)

(52) U.S. Cl.
USPC ..... 473/224; 473/223

(58) Field of Classification Search
USPC ..... 473/219, 221, 222, 223, 224, 226, 228, 473/229, 231, 238, 266, 269
See application file for complete search history.

(56) References Cited

U.S. PATENT DOCUMENTS

| | | | | |
|---|---|---|---|---|
| 3,730,530 | A | 5/1973 | Oka et al. | |
| 4,789,160 | A * | 12/1988 | Dollar et al. | 473/223 |
| 5,330,189 | A * | 7/1994 | Reichow | 473/224 |
| 6,899,633 | B1 | 5/2005 | Kienzle | |
| 7,427,238 | B1 * | 9/2008 | Oprandi et al. | 473/223 |
| 2007/0219744 | A1 | 9/2007 | Kolen | |

OTHER PUBLICATIONS

International Search Report mailed Aug. 3, 2011, and International Preliminary Report on Patentability mailed Sep. 14, 2012, for PCT/AU2011/000626, ISA/AU, Woden ACT, AU.

* cited by examiner

*Primary Examiner* — Nini Legesse
(74) *Attorney, Agent, or Firm* — Harness, Dickey & Pierce, PLC

(57) ABSTRACT

A swing feedback device, including (a) a body moveable relative to an apparatus, said apparatus having a strike face moveable by a user along a swing path for striking an object, said body being pivotable about a pivot axis to align itself to said swing path when moving with said apparatus; (b) one or more sensors attached to said body, said sensors for generating swing data including a detected position of a reference marker relative to said sensors, said reference marker being fixed relative to said strike face, the relative position of said reference marker and said sensors being determined based on an offset angle formed between said strike face and said body on a plane perpendicular to said pivot axis; and (c) a sound generator for generating auditory feedback for said user based on the swing data generated by said sensors.

20 Claims, 23 Drawing Sheets

SWING FEEDBACK DEVICE

CROSS-REFERENCE TO RELATED APPLICATIONS

This application is a 371 U.S. National Stage of International Application No. PCT/AU2011/000626, filed May 25, 2011, which claims priority to Australian Patent Application No. 2010902289, filed May 25, 2010. The disclosures of the above applications are incorporated herein by reference.

FIELD

The field relates to systems, devices and mechanisms for providing feedback on a user's control of an apparatus during a swing. The invention is particularly useful in relation to providing feedback on a user's control of a golf club during a swing, and it will therefore be convenient to describe the invention in that environment. However, it should be understood that the invention is intended for broader application and use.

BACKGROUND

Activities such as golf or tennis require a player to swing an apparatus (e.g. a club or racquet) along a swing path to strike an object with a strike face. The swinging apparatus propels the object in a direction perpendicular to the strike face at the point of impact. If the strike face is square to the swing path, the object will travel along the swing path which is the intended direction of travel. However, if the strike face is angled away from (and not square to) the swing path, the object will travel along a path deviating away from the swing path.

A player's control of the apparatus during a swing (e.g. its swing velocity and its orientation relative to the swing path) depends on the player's, control of many factors, including complex biomechanical interactions between the player and the apparatus. The player's control of these factors directly affects the object's direction of travel. Since it can be difficult for a player to be always in conscious control of the factors affecting the swing, it is difficult to ensure that the strike face is always square to the ball in each swing. Accordingly, there will always be some degree of variation in the object's direction of travel relative to the swing path between different swings. In the absence of suitable feedback, it is difficult for players to identify alignment errors and make corrections when the strike face is not square to the swing path during a swing.

Several solutions have been proposed. U.S. Pat. No. 7,427,238 describes a golf swing guide device. The device has a housing that is releasably attachable to a lower end of a golf club shaft. The housing includes a laterally extending stationary member pointing in a fixed direction perpendicular to the club face (representing the ball's intended direction of travel). The housing also includes a wind vane extending away from the stationary member, and which is pivotable about an axis parallel to the shaft of the club. The wind vane responds to air movement to align itself along the swing path of the club. A magnet is attached to the wind vane, the position of which (relative to the housing) is electronically detected based on the relative proximity of the magnet to two separate Hall effect sensors, each being fixed to a different respective portion of the housing. When the strike face is not square with the ball at the point of impact, the electronic circuit of the device generates (at the point of impact) an audible or viewable signal representing the strike face's deviation from the swing path based on the wind vane's direction and angular deviation relative to the stationary member.

There are several problems with this approach. The device is unable to produce feedback in the absence of electrical power. Also, the device only produces a signal at the moment of impact between the club face and the ball, and does not attempt to provide the player with continuous feedback during the entire swing. The device therefore does not give players the opportunity to correct a swing before striking the ball. The device is also unable to provide feedback on club velocity, which is an important factor contributing to a player's control of the swing. The device also relies on electrical power (from a battery) in order to be able to detect the angular deviation the wind vane and generate the feedback signal.

A further problem with this approach is that the use of a wind vane alone can often cause the housing to travel in an unstable manner. In order for the wind vane to operate efficiently, and align itself with the swing path, it requires a stable wind flow for stability. However, during a swing of a golf club, the wind flow will quite often be turbulent and unstable, due partly to the high velocity at which the golf club travels, and also due to side winds. As a result of this turbulent and unstable wind flow, the housing may tend to 'flutter', and not smoothly align itself to the swing path.

Other proposed solutions are described below, which involve detecting misalignment between the club face and the ball (or swing path) based on inertia, or the direction or speed of air flow relative to the apparatus. None of these solutions involve detecting the position of a member that pivots relative to the apparatus in response to air flow.

For example, U.S. Pat. No. 5,836,829 describes both a mechanical and electronic embodiment of a golf swing training device. The mechanical embodiment comprises an arm that extends in parallel to the club face of a golf club, and is attached to the shaft of the club. The arm has a lever (with a weight attached at one end) that pivots about a horizontal hinge. An outer end of the lever (distal from the shaft) has a pendulum (incorporating a pin) that pivots about a vertical hinge. In normal operation, the club face and the pendulum are aligned perpendicularly to the swing path producing a straight drive. This aligns the pin to a hole in the arm. The forces acting on the weight during a swing causes the lever to move towards the club head, and compress a diaphragm producing a "popping" sound. If the club face is oriented to produce a slice or a hook, the pendulum moves the pin away from the hole so that the lever is unable to move towards the club head and compress the diaphragm (so no "popping" sound is produced). The electronic embodiment includes accelerometers and light sensors for detecting any offset of the pendulum relative to a position perpendicular to the swing path. The device electronically detects and generates four distinct sounds to provide the player with instantaneous feedback on the smoothness throughout the swing and the club face orientation relative to the ball at the point of impact. A sound is produced when the player's swing is correctly aligned. If a slice or hook would have occurred, due to improper club head orientation, the device produces a sound of rising or falling pitch. A sound is produced if there is excessive acceleration during the backswing to indicate an unsmooth swing.

U.S. Pat. No. 3,776,556 describes a golf swing training device attached to a golf club shaft. The device has a "tear drop shaped" hollow body defining two separate channels respectively in the upper and lower half of the body. Each channel includes a different whistle (e.g. for producing a different sound). The channels constitute two wind chambers angled so as not to trap air when the club travels straight ahead perpendicularly to the intended line of flight. But when the club is being drawn diagonally across the ball (e.g. inwardly as in FIG. 4B or outwardly as in FIG. 4C), air passes through the wind chamber on the frontally exposed side and the respective whistle instantly indicates whether a hook or slice swing has resulted.

U.S. Pat. No. 3,730,530 describes a golf swing training device comprising a whistle and a fixing member. The fixing member includes a suction disk and a portion adapted to hold the whistle. The whistle includes a changeable vibration plate, a plate receiving tray and a cylindrical body for retaining the plate and the tray. The suction disk attaches the device to the head of a golf club. When attached, the whistle is ideally square in relation to the club face. When the club is swung at an appropriate speed and angle (relative to the air inlet of the device), the whistle captures air to produce a sound.

U.S. Pat. No. 4,789,160 describes a swing position indicator device for a sports implement (e.g. a golf club). The device is attached to the shaft of a sports implement, and includes two position orientation sensors. The sensors detect the pitch and roll of the striking surface respectively. When both of these sensors indicate that the striking surface is properly oriented, a sound is generated. The sound is maintained for as long as the striking surface is properly oriented.

U.S. Pat. No. 5,277,428 describes a golf club swing training device. The device includes a housing for mounting onto a golf club in at least two different positions. When mounted in a first position, a transducer inside the housing monitors deviation of golf club travel from a linear direction during a swing. When mounted in a second position, the transducer monitors the acceleration of the golf club during a swing. The transducer comprises of optical reflective detectors for monitoring the offset positions of a mass on the upper end of a cantilevered spring having its lower end fixed to a circuit board including an aperture therein in which the mass is disposed.

It is therefore desired to address one or more of the above problems, or to at least provide a useful alternative.

SUMMARY

According to an aspect of the present invention, there is provided a swing feedback device, including:

(a) a body moveable relative to an apparatus, said apparatus having a strike face moveable by a user along a swing path for striking an object, said body being pivotable about a pivot axis to align itself to said swing path when, moving with said apparatus;

(b) one or more sensors attached to said body, said sensors for generating swing data including a detected position of a reference marker, relative to said sensors, said reference marker being fixed relative to said strike face, the relative position of said reference marker and said sensors being determined based on an offset angle formed between said strike face and said body on a plane perpendicular to said pivot axis; and (c) a sound generator for generating auditory feedback for said user based on the swing data generated by said sensors.

The body preferably includes a connecting portion being adapted for releasably coupling the body to the apparatus, such that when the body is coupled to said apparatus, the connecting portion is rotatable about said pivot axis. In a preferred embodiment of the present invention, the body is releasably coupled to the shaft of golf club near the head or strike face of the club.

The swing feedback device may further include a collar securely attachable to the apparatus; wherein the connecting portion is adapted for releasably coupling the body to the collar, such that when the connecting portion is coupled to the collar when attached to the apparatus, the connecting portion is pivotable about the pivot axis. In a representative embodiment of the present invention, the collar may be permanently attached to the shaft of a golf club. By having such collars permanently attached to a number of different golf clubs, the user can quickly and efficiently attach the body of the swing feedback device to the golf club currently being used. This is particular advantageous, as it is common for a player to use a number of different golf clubs during a round of play.

In one embodiment of the present invention, the connecting portion may be pivotable about the pivot axis within a predetermined pivot angle range relative to the strike face.

In a preferred embodiment of the present invention, the reference marker is located on an outer surface of the collar to allow for inspection of the reference marker by the one or more sensors. Alternatively, if no collar is used with the swing feedback device, then the reference marker may be located directed on the apparatus, such as, for example, the shaft of a golf club. Advantageously, the position of the reference marker (whether on the collar or directly on the apparatus) should be perpendicular to the strike face of the apparatus. However, it should be understood that it is also possible for the reference mark to be positioned on the apparatus in other orientations, relative to the strike face, so long as the position of the reference marker is able to be inspected or monitored by the one or more sensors.

If the collar is used to attach the device to the apparatus, then the correct alignment of the reference marker can be performed by eye (i.e. by the user placing the collar on the apparatus) or by using an optional attachment tool to correctly orient and align the reference marker with the strike face.

The one or more sensors may be held in a fixed position relative to said body. Advantageously, the sensors are contained within, and fixed to, the body of the device so as to prevent damage during use of the apparatus. In a preferred embodiment of the invention, the sensors include at least one optical sensor contained within the device, and positioned within the body to allow inspection of the reference marker.

The body may also include a vent located at an end of the body, the vent being in inward communication with an annular space between the collar and the connecting portion, such that when the apparatus and the body moves along the swing path pressurised air is forced into the annular space, the pressurised air acting to reduce the frictional coefficient between the collar and the connecting portion. In this regard, it should be understood that the pressured air results from the aerodynamic shape of the vent, and the relative speed at which the body travels when attached to the apparatus and moving along the swing path.

The body of the device may include a weight positioned at an end portion of the body distal from the pivot axis, the weight for aligning the body along the swing path when the apparatus and the body moves along the swing path.

Advantageously, the body is adapted to serve as a wind vane, and includes one or more flow directing surfaces responsive to a flow of air around said body for aligning the body along the swing path when the apparatus and the body moves along the swing path. The body may also include a sleeve member defining an internal flow channel that is responsive to a flow of air around the body to align the body along the swing path when the apparatus and the body moves along the swing path.

It is preferable that the swing feedback device also includes an analysis module adapted for processing the swing data from the one or more sensors to perform one or more of the following:

i) generate, based on the swing data, audio data representing an audio signal for the sound generator;
ii) generate, based on the swing data, audio data representing an audio signal for a line out component;
iii) generate, based on the swing data, audio data representing an audio signal for an external sound generator remote from the device;
iv) generate results data, including the swing data and other ancillary data representing one or more of a date, time, practice session identifier, device sensitivity, rank, score and rating, and store the results data into a data store; and
v) generate, based on the swing data, control data for manipulating the position, movement or other characteristics a user interface component displayed to a user via a display.

The swing data may be provided to the analysis module by at least one of a wired or wireless communication link.

In one embodiment of the present invention, the sound generator may receive the audio signal from the analysis module and generate the auditory feedback for the user based upon the audio signal. However, in an alternative embodiment, the audio signal may be received by an external sound generator.

The feedback provided to the user may include at least one of:

i) producing sound of a predefined pitch when the offset angle is within a predetermined response angle range, and not producing sound when the offset angle is not within the predetermined response angle range;
ii) producing sound of a predefined pitch when the offset angle is not within a predetermined response angle range, and not produce sound when the offset angle is within the predetermined response angle range;
iii) producing sound of varying pitch based on changes in the offset angle within said predetermined response angle range;
iv) producing sound of varying pitch based on changes in the offset angle when outside of the predetermined response angle range; or
v) producing sound of different intensity based on a swing velocity of the apparatus moving with the body along the swing path.

In a preferred embodiment of the present invention, the predetermined response angle range is adjustable by a user. An adjustment of the response angle range may be performed by the user in order to select a suitable sensitivity of the device that may correspond to the user's skill level (e.g. beginner, intermediate, advanced, professional).

The response angle may include any offset angle between a first threshold angle and a second threshold angle on the plane, each of the first and second threshold angles deviating at different respective angles away from a reference axis extending along the plane and perpendicular to the strike face.

The swing data generated by the sensors may also include one or more of:

i) data representing a swing velocity of the apparatus moving with the body along the swing path;
ii) data representing a position on the strike face that is impacted by the object during the swing path;
iii) data representing a swing plane angle of the apparatus during the swing path; or
iv) data representing swing frequency of the apparatus.

The sensors may include one or more of optical sensors, magnetic sensors, shaft encoders, linear position sensors, displacement sensors, accelerometers, gyroscopes, and tilt switches. In a preferred embodiment of the present invention, optical sensors are used to generate swing data including the detected position of a reference marker relative to the sensors. However, it should be understood that other suitable sensors could also be used to generate this swing data.

According to a further aspect of the present invention, there is provided a swing feedback device, including:

(a) a body moveable relative to an apparatus, said apparatus having a strike face moveable by a user along a swing path for striking an object, said body being pivotable about a pivot axis to align itself to said swing path when moving with said apparatus;
(b) wherein, said body includes an adjustable whistle assembly for providing different auditory feedback for said user when air flows past a first opening of said assembly, said assembly being adjustable based on an offset angle formed between said strike face and said body on a plane perpendicular to said pivot axis.

The whistle assembly may also include:

i) a housing enclosing a whistle chamber; and
ii) a barrier member moveable relative to said housing based on said offset angle;

wherein, said barrier member covers a second opening of said housing when said offset angle is within said predefined response angle range, and exposes said second opening when said offset angle is not within said predefined response angle range.

According to a still further aspect of the present invention, there is provided a swing feedback device, including:

(a) a body attachable to an apparatus, said apparatus having a strike face moveable by a user along a swing path for striking an object, said body being pivotable about a pivot axis that extends along a support portion of said apparatus;
(b) one or more sensors attached to said body, said sensors being adapted to generate swing data including an offset angle formed between said strike face and said swing path during travel of said strike face along said swing path; and
(c) a sound generator for generating auditory feedback for said user based on the swing data generated by said sensors.

It is preferable that the body is only pivotable about the pivot axis during initial attachment of the body to the apparatus. Thereafter, and in accordance with a representative embodiment of the present invention, the body preferably remains in a fixed position relative to the support portion of the apparatus throughout the movement of the strike face along the swing path.

Advantageously, the swing data and the resulting auditory feedback are generated in real time. It is widely understood in relation to real-time computing, that the expression 'real time' refers to a system in which input data is processed within a very short period of time (e.g. microseconds or milliseconds) such that it is available almost immediately as feedback. In a representative embodiment of the present invention, the delay in generation of the auditory feedback (following measurement by the sensors) may be approximately 50 microseconds, and is therefore considered to constitute real time auditory feedback.

It is preferable that the swing data also includes an offset angle formed between the strike face and the swing path at the moment of impact between the strike face and the object. It is advantageous to generate swing data that includes this offset angle at the moment of impact between the strike face and object, since the object's actual direction of travel depends on the angular orientation of the strike face relative to the swing path at the point of impact with the object.

During attachment of the body to the apparatus, the body may be pivotally aligned within a predefined tolerance angle range about a plane extending perpendicular to the strike face. Advantageously, the body is pivotally aligned within a predefined tolerance angle range that extends rearward of the strike face. The predefined tolerance angle range may comprise a deviation of up to 45 degrees either side of the plane. More preferably, the predefined tolerance angle range may comprise a deviation of up to 30 degrees either side of the plane, or still more preferably a deviation of up to 20 degrees either side of the plane.

It is preferable that the swing feedback device also includes an analysis module adapted for processing the swing data from the one or more sensors to perform one or more of the following:

i) generate, based on the swing data, audio data representing an audio signal for the sound generator;
ii) generate, based on the swing data, audio data representing an audio signal for a line out component;
iii) generate, based on the swing data, audio data representing an audio signal for an external sound generator remote from the device;
iv) generate results data including the swing data and other ancillary data representing one or more of a date, time, practice session identifier, device sensitivity, rank, score and rating, and store the results data into a data store; and
v) generate, based on the swing data, control data for manipulating the position, movement or other characteristics a user interface component displayed to a user via a display.

The swing data may be provided to the analysis module by at least one of a wired or wireless communication link. Furthermore, the sound generator may receive the audio signal from the analysis module and generate the auditory feedback for the user based upon the audio signal. In accordance with a particularly preferred embodiment of the present invention, both the analysis module and the sound generator are located within the body of the device that is attached to the support portion of the apparatus, such that auditory feedback can be provided to the user in the shortest possible time. However, in an alternative embodiment, the analysis module may be located external to the body of the device such as, for example, in an external peripheral device. In such an embodiment, the analysis module may receive swing data from the sensors via a wireless communication link.

According to a still further aspect of the present invention, there is provided a swing feedback device, including:

(a) a body attachable to an apparatus, said apparatus having a strike face moveable by a user along a swing path for striking an object, said body being attachable to a support portion of said apparatus and aligned within a predefined tolerance angle range about a plane extending perpendicular to said strike face;
(b) one or more sensors attached to said body, said sensors being adapted to generate swing data including an offset angle formed between said strike face and said swing path during travel of said strike face along said swing path; and
(c) a sound generator for generating auditory feedback for said user based on the swing data generated by said sensors.

It is preferable that the body is only pivotable about the pivot axis during initial attachment of the body to the apparatus. Thereafter, the body preferably remains in a fixed position relative to the support portion of the apparatus throughout the movement of the strike face along the swing path.

Advantageously, the swing data and the resulting auditory feedback are generated in real time.

According to a still further aspect of the present invention, there is provided a sporting apparatus for use by a user in a sporting activity including a swing feedback device in accordance with either of the preceding two aspects of the invention. In addition, the device may be attachable to an area of the support portion proximate the strike face. For example, and in relation to a preferred embodiment of the present invention, the device may be attached to the shaft of a golf club at a position approximately 6 inches from the head of the golf club. However, it is should be understood that the device is capable of being attached much nearer to the head of the golf club, and even directly adjacent the strike face of the golf club if such an arrangement is desired. Advantageously, the swing data generated by the sensors is more accurate when the device is positioned proximate the strike face, since flexion of the support portion (during movement of the strike face along the swing path) has much less of an influence on the accuracy of the data.

In an alternative embodiment of the present invention, the device may be integrally formed with the sporting apparatus. For example, the device may be incorporated into the support portion of the apparatus (e.g. the shaft or handle of the golf club), during or after manufacture.

BRIEF DESCRIPTION OF THE DRAWINGS

Representative embodiments of the present invention will now be described with reference to the accompanying drawings. These embodiments are given by way of illustration only and other embodiments of the invention are possible. Consequently, the particularity of the accompanying drawings are not to be understood as superseding the generality of the preceding description. In the drawings:

FIGS. 84 and 85 are perspective views of another representative electro-mechanical embodiment of the feedback device.

DETAILED DESCRIPTION OF THE REPRESENTATIVE EMBODIMENTS

Embodiments of the swing correction device will now be described with reference to the accompanying drawings. The invention is particularly useful in relation to providing feedback on a user's control of a golf club during a swing, and it will therefore be convenient to describe the invention in that environment. However, it should be understood that the invention is intended for broader application and use.

Figure 1:
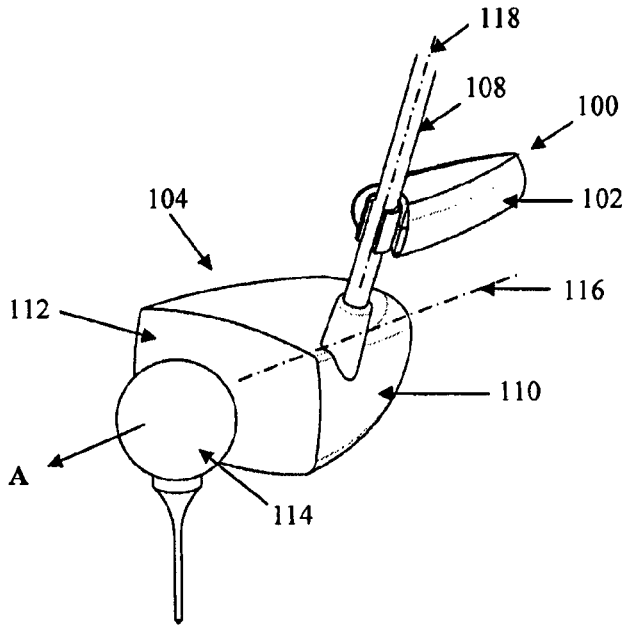
FIG. 1 shows a swing feedback device coupled to an apparatus.

A swing feedback device 100, as shown in FIG. 1, includes a body 102 that is pivotable relative to an apparatus 104. The body 102 pivots about a pivot axis 118. In this specification, an apparatus 104 refers to any piece of equipment moveable by a person (or user) along a swing path for striking an object (such as a ball). For example, the apparatus 104 may be a piece of sporting equipment, e.g. a golf club or tennis racquet.

The apparatus 104 includes a handle portion 106 (not shown in FIG. 1), a support portion 108, and a head portion 110. The handle portion 106 is held by the user when the apparatus 104 is in use. The support portion 108 (e.g. the shaft of a golf club as shown in FIG. 1) extends between the head portion 110 and the handle portion 106 and holds the head and handle portions 110 and 106 together at a fixed distance from each other. The head portion 110 includes a strike face 112 for striking an object 114.

In the representative embodiment shown in FIG. 1, the body 102 is a separate component that is releasably coupled to the support portion 108 (or shaft) of the apparatus 104, and the pivot axis 118 extends along the shaft of the apparatus 104. This configuration can provide several advantages. Different bodies 102 can be provided for interchangeable use with a single apparatus 104, where each body 102 may be adapted for providing a different type, range or sensitivity of feedback to the user. The detachable configuration allow the body 102 to be replaced if it is damaged, reattached for use on another apparatus 104 (e.g. on a different golf club), or for the apparatus 104 to be used without the device 100. However, in another representative embodiment, the body 102 can be a moveable part that is shaped from (or is permanently attached to) the apparatus 104.

The user swings the apparatus 104 to move the head portion 110 along a swing path 116. When the strike face 112 comes into contact with the object 114 (such as, for example, a golf ball), the object 114 is driven in a direction (represented by arrow A) that is substantially perpendicular to the strike face 112. The object's 114 intended direction of travel therefore corresponds to the direction of the swing path 116 at the point of impact with the object 114. However, the object's 114 actual direction of travel depends on the angular orientation of the strike face 112 relative to the swing path 116 at the point of impact with the object 114.

Figure 2:
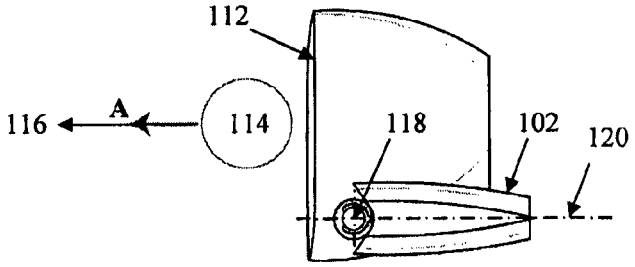
FIGS. 2 to 4 show various configurations of the swing feedback device when in use.

In an ideal swing, as shown in FIG. 2, the strike face 112 is aligned substantially perpendicular to the swing path 116 at the point of contact with the object 114. At the point of contact, the strike face 112 drives the object 114 in the direction of the swing path 116 (represented by arrow A), and the object 114 travels in its intended direction of travel.

Figure 3:
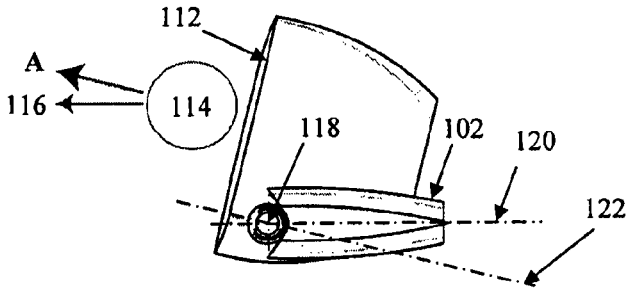
Figure 4:
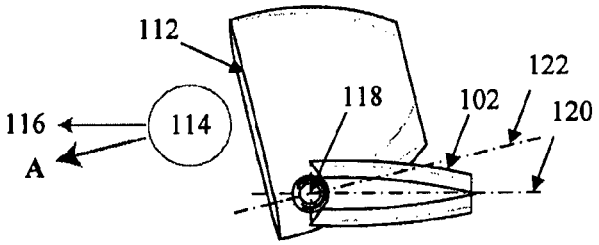

However, in some situations, the user may inadvertently misalign the strike face 112 so that the strike face 112 is angled relative to the swing path 116 (e.g. due to inadvertent rotation of the user's wrist during a swing). An offset angle refers to the angle formed between the swing path 116 and the strike face 112 (e.g. a tangent of the strike face 112) along a plane perpendicular to the pivot axis 118. FIG. 3 shows an example an apparatus 104 with a strike face 112 angled away from the user (e.g. forming a positive offset angle) which results in a slice. FIG. 4 shows an example of an apparatus 104 with a strike face 112 angled towards the user (e.g. forming a negative offset angle) which results in a hook. In both examples, the strike face 112 drives causes the object 114 in a direction (represented by arrow A) deviating away from its intended direction of travel, which is undesirable and often unpredictable.

A feature of the swing feedback device 100 is that the body 102 is pivotable about the pivot axis 118 so that a longitudinal axis 120 of the body 102 is substantially aligned with (e.g. follows along) the swing path 116 when the body 102 moves with the apparatus 104 along the swing path 116.

In a representative embodiment of the present invention, the body 102 includes a whistle assembly 1800 and 1900 (see FIGS. 18 and 19) that is adjustable in configuration for providing different auditory feedback for the user depending on its configuration. The whistle assembly 1800 and 1900 may be adjustable (or reconfigurable) by the rotation of the strike face 112 relative to the swing path 116 along a plane perpendicular to the pivot axis 118, for producing different auditory feedback for the user based on the resulting offset angle formed.

The adjustable whistle assembly 1800 and 1900 may produce sound of certain characteristics (e.g. including one or more of pitch and intensity) for indicating to the user that the apparatus 104 is in a predetermined response orientation, state or configuration (relative to the swing path 116) during the user's swing. The adjustable whistle assembly 1800 and 1900 may be configured to not produce sound (e.g. any sound, or only sound of certain characteristics) when the apparatus 104 is not in a predetermined response orientation, state or configuration. For example, in a representative embodiment, the adjustable whistle assembly 1800 and 1900 is able to provide at least one of the following types of auditory feedback:

i) produce sound of a predefined pitch when the offset angle is within a predetermined response angle range, and not produce sound (or produce sound of a different pitch) when the offset angle is not within the predetermined response angle range;

ii) produce sound of a predefined pitch when the offset angle is not within a predetermined response angle range, and not produce sound (or produce sound of a different pitch) when the offset angle is within the predetermined response angle range;

iii) produce sound of varying pitch based on changes in the offset angle within the predetermined response angle range;

iv) produce sound of varying pitch based on changes in the offset angle when outside of the predetermined response angle range; and v) produce sound of different intensity based on a swing velocity of the apparatus 104 moving with the body 102 along the swing path 116.

The response angle range refers to any offset angle that can be formed by the device 100 between a first threshold angle and a second threshold angle. The first and second threshold angles each corresponds to a different angle of deviation (along a plane perpendicular to the pivot axis 118) relative to the strike face 112. The first and second threshold angles can be determined in other ways, and for example, may each correspond to a different angle of deviation away from a reference axis 122 extending perpendicular to the strike face 112 (and through the pivot axis 118).

The response angle range defines a range of offset angles based on which the device 100 can provide feedback, and therefore, determines the sensitivity of the device 100 for providing feedback to the user. The first and second threshold angles may be set to different angles for different embodiments of the body 102 (e.g. according to Table 1), to provide different level of sensitivity for users with different levels of skill in using or controlling the apparatus 104. For example, an embodiment of the device 100 for beginners may have a relatively wide response angle range, and other embodiments of the device 100 for intermediate players, advanced players and experts may have each be adapted to provide a progressively smaller response angle range. In Table 1, a positive angle represents rotation of the strike face 112 relative to the swing path 116 in a first direction (e.g. in a clockwise direction), and a negative angle represents rotation of the strike face 112 relative to the swing path 116 in an opposite direction (e.g. in an anti-clockwise direction).

TABLE 1

| | First threshold angle | Second threshold angle |
|---|---|---|
| Embodiment 1 (Beginner) | +18 degrees | −18 degrees |
| Embodiment 2 (Intermediate) | +12 degrees | −12 degrees |
| Embodiment 3 (Advanced) | +6 degrees | −6 degrees |
| Embodiment 4 (Expert/Pro) | +3 degrees | −3 degrees |
| Embodiment 5 (Variable pitch between threshold angles) | +18 degrees | −18 degrees |
| Embodiment 6 (Adjustable 1) | An angle adjustably set between +10 and +20 degrees (inclusive) | An angle adjustably set between −10 and −20 degrees (inclusive) |
| Embodiment 7 (Adjustable 2) | An angle adjustably set between +1 and +10 degrees (inclusive) | An angle adjustably set between −1 and −10 degrees (inclusive). |

Embodiments 6 and 7 in Table 1 may be suitable for beginners and advanced users respectively. For these embodiments, the first and second threshold angles may be adjustable by 1 degree steps. In a representative embodiment, such adjustment are achieved based on a mechanical interaction between two or more components of the body 102 (e.g. by selectively positioning one component in a locking relationship relative to another component, or by controlling the degree of movement of a component based on an adjustable configuration or position of another component). However, in a further representative embodiment later described, electrical or electro-mechanical adjustment techniques (e.g. push buttons positioned on the body 102 of the device 100, or external control devices linked to the device 100 by either a wired or wireless connection) can also be used to adjust the response angle range of the device 100.

Figure 5:
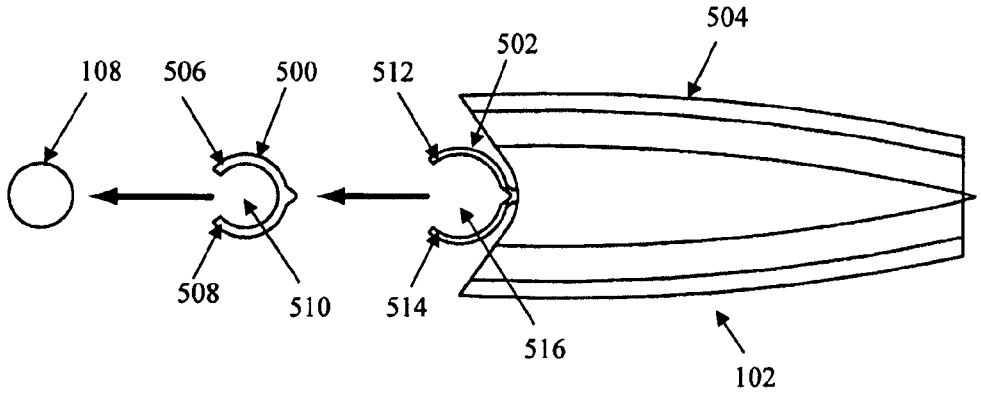
FIG. 5 is an exploded top view of the connecting components of the feedback device.
Figure 6:
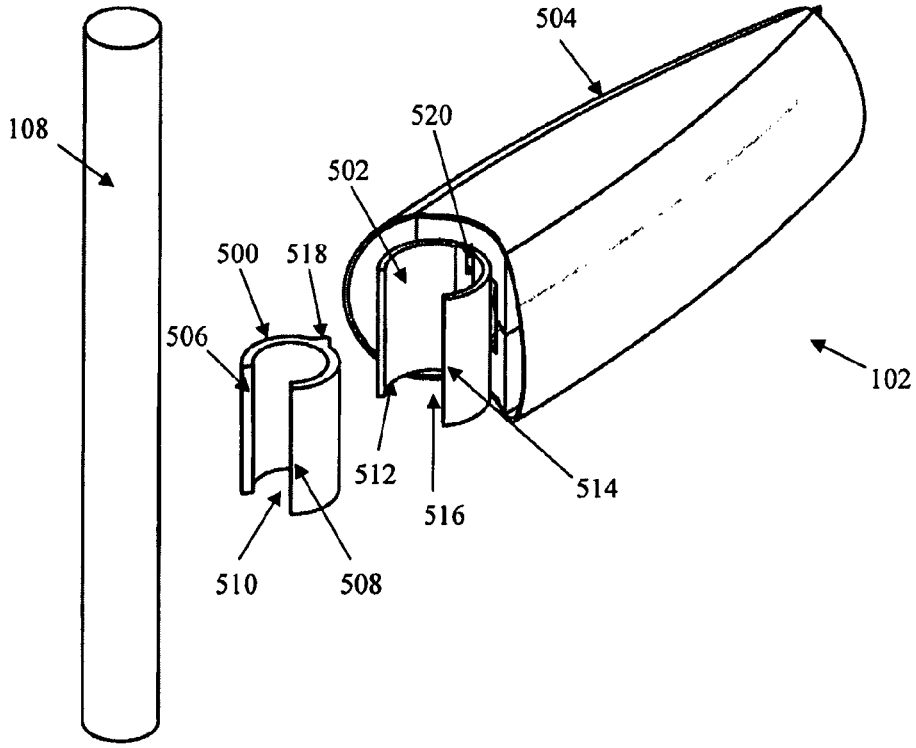
FIG. 6 is an exploded perspective view of the components shown in FIG. 5.

FIGS. 5 and 6 show a representative embodiment of the device 100 including a body 102 for releasably coupling to the apparatus 104. The embodiment shown in FIGS. 5 and 6 includes a collar 500 and a body 102. The body 102 has a connecting portion 502 and pivoting portion 504 are moveable relative to each other. The collar 500 is adapted for secure attachment to a support portion 108 of the apparatus 104. The collar 500 may be shaped (e.g. like a c-shaped clip) to define two end portions 506 and 508 that extend around an inner channel 510 having a cross-sectional shape corresponding to (e.g. generally follows) an outer surface of the support portion 108. When the collar 500 is pushed towards the support portion 108, the end portions 506 and 508 of the collar 500 move away from each other to receive the support portion 108 inside an inner channel 510. The collar 500 is adapted so that the end portions 506 and 508 are biased to move towards each other for securely engaging an outer surface of the support portion 108. This engagement resists detachment of the collar 500 from the support portion 108, and also resists rotation of the collar 500 relative to the support portion 108. In this manner, the collar 500 is held in a fixed position relative to the apparatus 104, and is rotatable about the pivot axis 118 together with the strike face 112.

In a similar manner, the connecting portion 504 of the body 102 may be adapted for releasably coupling to the collar 500 (or alternatively, for releasably coupling to a support portion 108 directly). The connection portion 504 may include two end portions 512 and 514 that extend around an inner channel 516. The end portions 512 and 514 can move away from each other for receiving the collar 500 (or support portion 108) in the inner channel 516, and are biased to move towards each other to secure engage with an outer surface of the collar 500

(or support portion 108) to resist detachment of the body 102 from the collar 500 (or support portion 108).

The connecting portion 502 may have a recess 520 shaped for receiving a notch 518 (or other projection) formed on either an outer surface of the collar 500 or the support portion 108. When the notch 518 is received into the recess 520 of the connecting portion 502, the collar 500 and connecting portion 502 are secured in a fixed position relative to each other to resist rotation of the connecting portion 502 relative to the collar 500. When the collar 500 in fixed to the apparatus 104 (as described above), the engagement between the collar 500 and connecting portion 502 ensures that the connecting portion 502 is also held in a fixed position relative to the apparatus 104. In this manner, the connecting portion 502 is rotatable about the pivot axis 118 together with the collar 500 and strike face 112.

The pivoting portion 504 of the body 102 is pivotable about the pivot axis 118 for movement within a predetermined pivot angle range relative to the connecting portion 502. For example, when the connecting portion 502 is secured in a fixed position relative to the apparatus 104 (and therefore the strike face 112), the pivoting portion 504 is able to pivot within a predetermined pivot angle range relative to the strike face 112. In a representative embodiment, the engagement between the notch 518 and recess 520 aligns the body 102 so that its pivot angle range is centred on the reference axis 122. The pivot angle range may be determined in the same way as the response angle range, and the pivot angle range may be greater than (or at least equal) to the response angle range.

Figure 7:
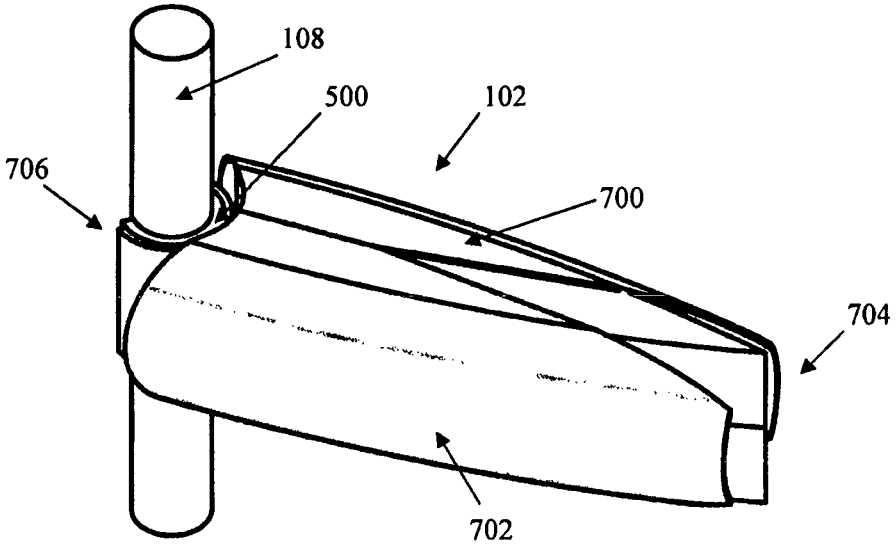
FIG. 7 shows an embodiment of the feedback device with an adjustable clamp body.

FIG. 7 shows a representative embodiment of the swing feedback device 100 where the body 102 includes two clamp portions 700 and 702. Each of the clamp portions 700 and 702 has a distal end 704 and proximate end 706. When a user moves the distal ends 704 of the clamp portions 700 and 702 towards each other, the proximate ends 706 of clamp portions 700 and 702 move away from each other towards an open position for receiving the collar 500 (or a part of the support portion 108). The proximate ends 706 of the clamp portions 700 and 702 are biased to move towards each other (and towards a closed position), so that in the absence of force moving the distal ends 704 towards each other, the proximate ends 706 move towards a closed position for engaging an outer surface of the collar 500 (or support portion 108).

Figure 8:
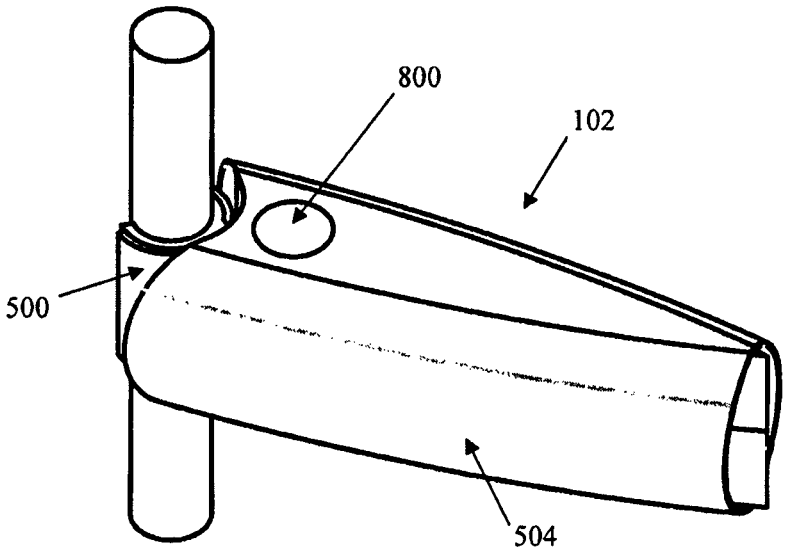
FIG. 8 shows an embodiment of the feedback device with a swivel lock mechanism.

FIG. 8 shows a representative embodiment of the swing feedback device 100 including a lock button 800. In use, a user presses the lock button 800 to activate a locking mechanism located inside the body 102, which holds the connecting portion 502 and pivoting portion 504 together in a fixed relationship to resist one from rotating relative to the other. This can help with the installation of the device 100 to the apparatus 104. For example, a user can hold onto the body 102 and press the lock button 800 to hold the connecting portion 502 in place, so that the connecting portion 502 can be fitted over the collar 500 or support portion 108 with minimal rotational movement relative to the rest of the body 102.

FIGS. 9 to 13 show how different embodiments of the body 102 align the body 102 to the swing path 116 during a swing.

Figure 10:
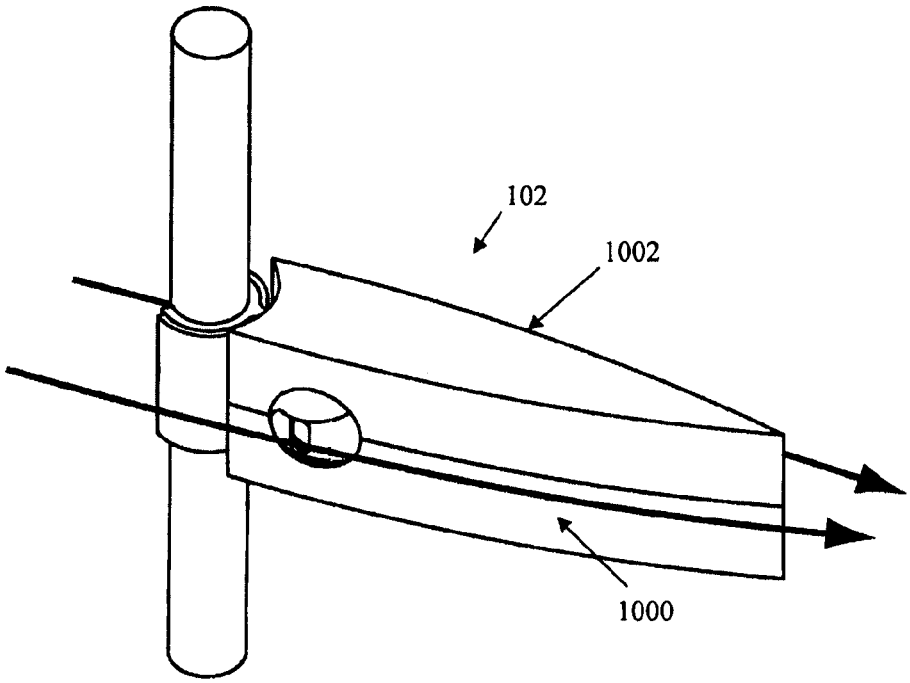
FIG. 10 shows an embodiment of the feedback device adapted as a vane in use.
Figure 11:
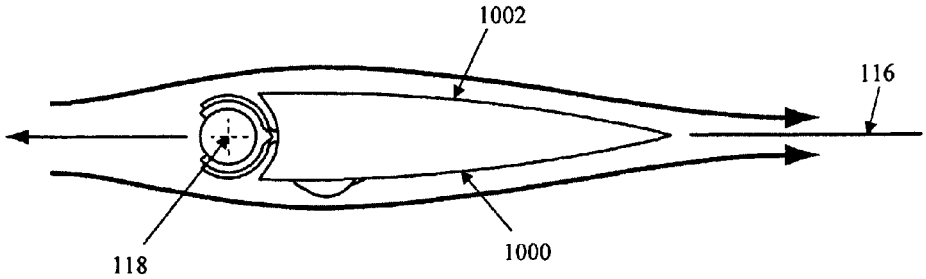
FIGS. 11, 12 and 13 show different embodiments of the feedback device in use.

FIGS. 10 and 11 show a representative embodiment of the device 100 where the body 102 is adapted to serve as a wind vane. The body 102 includes two flow directing surfaces 1000 and 1002 extending along the length of the body 102 for guiding a flow of air around the body 102. During a swing, a flow of air around the body 102 pushes against each of the flow directing surfaces, 1000 and 1002 to move them respectively towards a position of least resistance (or least disruption) to the general flow of air around the body 102. As a result, the length of the body 102 is aligned with (or along) the swing path 116 during a swing.

Figure 9:
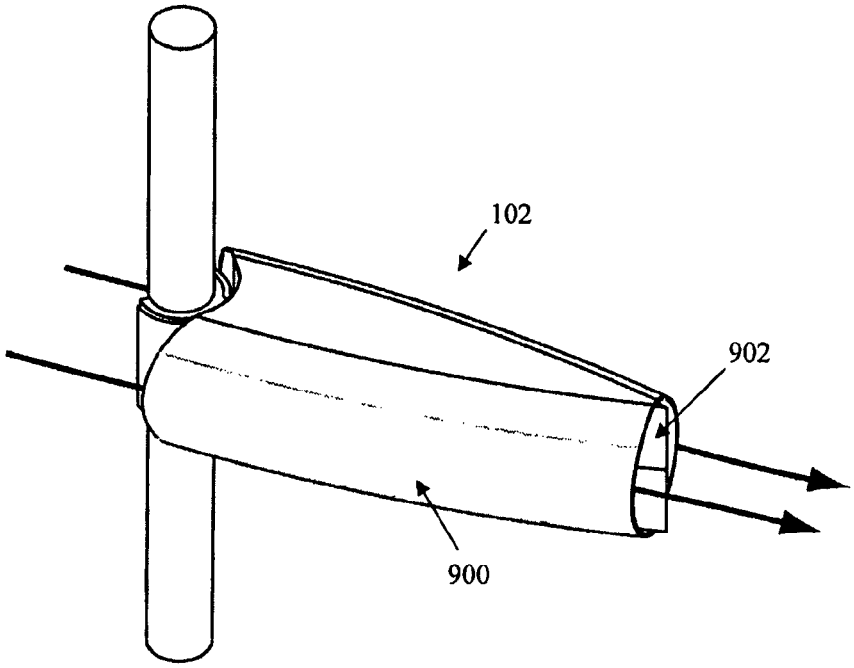
FIG. 9 shows an embodiment of the feedback device with a sleeve in use.
Figure 12:
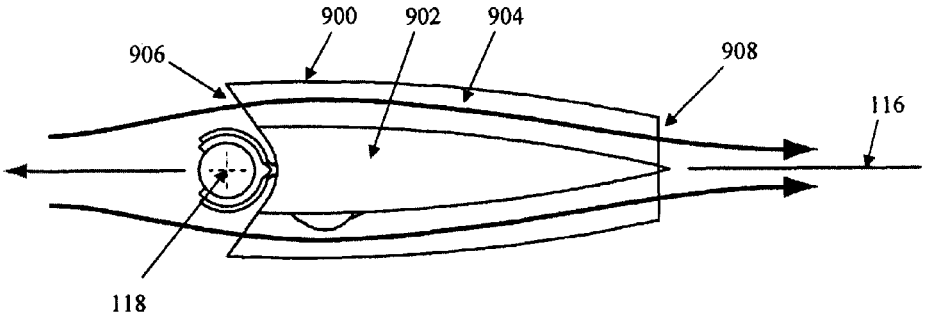

FIGS. 9 and 12 show a representative embodiment of the device 100 including a sleeve member 900 fitted around a core portion 902 of the body 102. The sleeve member 900 defines an internal flow channel 904 for receiving a flow of air via an inlet 906 and funnelling the flow of air between an inner surface of the sleeve member 900 and an outer surface of the core portion 902 of the body 102. The flow of air leaves the body 102 via outlet 908. When air enters the channel 904, the air pushes against the inner surface on one side of the sleeve 900, which pushes the sleeve member 900 in one direction away from the swing path 116. This is counteracted by a force exerted by the air pushing against the inner surface on an opposite side of the sleeve 900, which pushes the sleeve member 900 in an opposite direction away from the swing path 116 (e.g. similar to the operation of a window sock). The result of the forces exerted by the air moving inside the channel 904 moves the body 102 to an equilibrium position, which results in aligning the body 102 with (or along) the swing path 116 during a swing.

Figure 13:
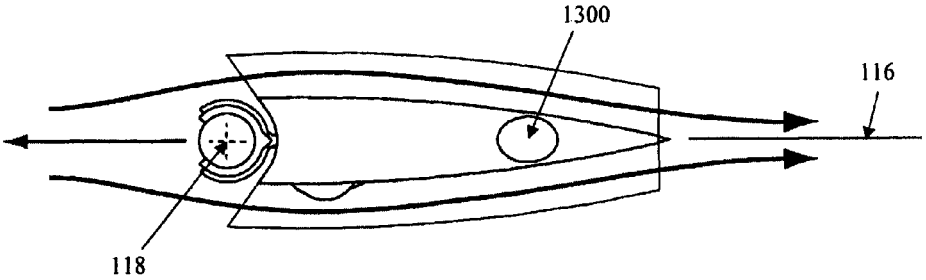

FIG. 13 relates to a body 102 including a weight 1300 at a distal end of the body 102 (i.e. that end of the body 102 which is further away from the pivot axis 118). As the body 102 moves along the swing path 116, the weight 1300 will follow the pivot axis 118 of the body 102 and move along the swing path 116. As a result, the body 102 is aligned with (or along) the swing path 116 during a swing. In the representative embodiment shown in FIG. 13, the weight 1300 is included as part of the body 102 for the embodiment shown in FIGS. 9 and 12. In another representative embodiment, the weight 1300 may be included as part of the body 102 for the embodiment shown in FIGS. 10 and 11.

Figure 14:
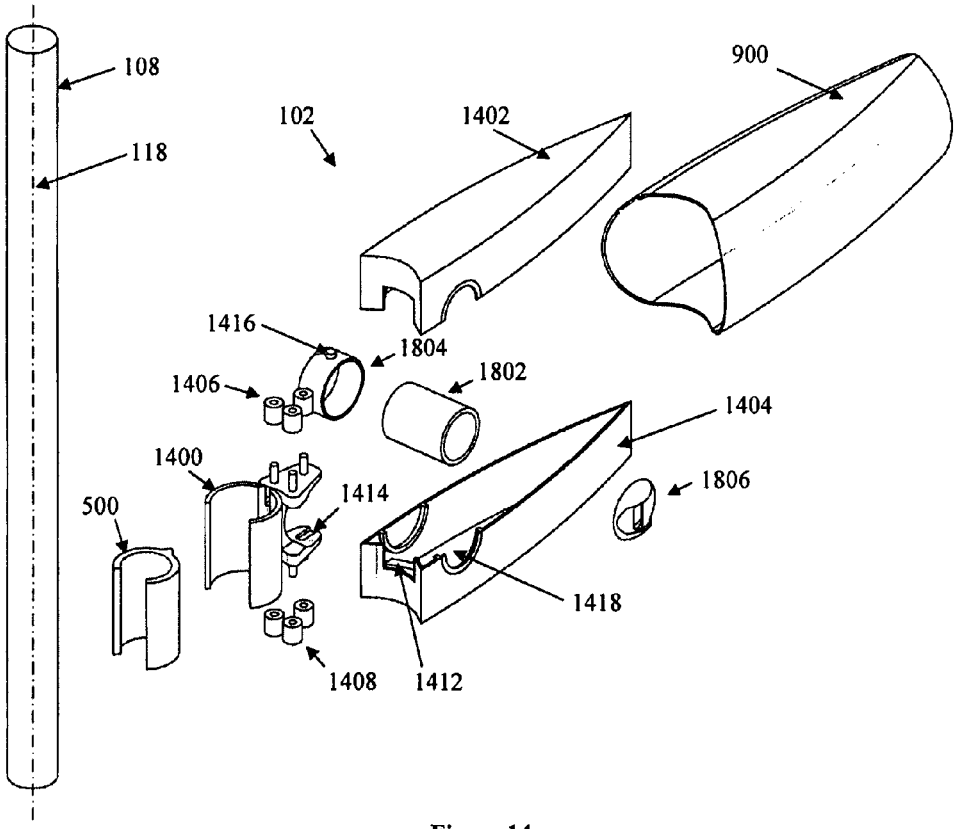
FIG. 14 is an exploded view of one embodiment of the feedback device.
Figure 15:
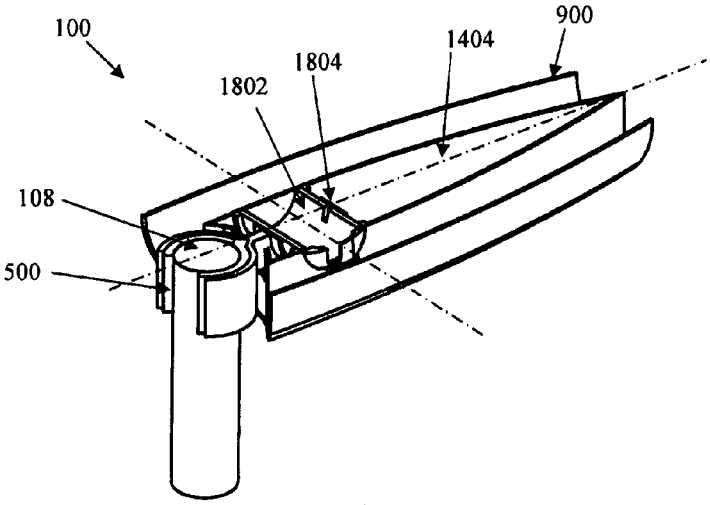
FIG. 15 is a sectional view of the feedback device shown in FIG. 14.

FIGS. 14 and 15 are exploded and sectional views of the components inside a representative embodiment of the body 102. The body 102 includes a bracket 1400, upper housing 1402, lower housing 1404, upper positioning members 1406, lower positioning member 1408, upper rib portion 1410, lower rib portion 1412, and an adjustable whistle assembly 1800 (which includes a whistle housing 1802, barrier member 1804 and cap member 1806). The body 102 may include a sleeve member 900.

The bracket 1400 is shaped to provide the connecting portion 502 of the body 102. The bracket 1400 also supports the upper and lower positioning members 1406 and 1408 in a fixed position relative to the bracket 1400. The positioning members 1406 and 1408 engage different rib portions 1410 and 1412 formed in the upper and lower housing 1402 and 1404 respectively. This engagement secures the upper and lower housing 1402 and 1404 to the bracket 1400, and allows the upper and lower housing 1402 and 1404 to pivot together relative to the pivot axis 118 whilst the bracket 1400 is held in a fixed position relative to the pivot axis 118. In a representative embodiment, the upper and lower positioning members 1406 and 1408 are different pinion sets. Each pinion set is arranged for receiving a different rib portion 140 (e.g. an internal gear) between two or more of the pinions in each set. It is possible to have different means for enabling the pivoting portion 504 to move relative to the connecting portion 502.

In a representative embodiment, the bracket 1400 is adapted to engage an actuating portion 1416 of the barrier member 1804. This engagement resists the barrier member 1804 from moving with the rest of the adjustable whistle assembly 1800 (i.e. the whistle housing 1802 and cap member 1806) which are able to pivot with the upper and lower housing 1402 and 1404 about the pivot axis 118. This enables the bracket 1400 to adjust the position of the barrier member

1804 relative to the whistle housing 1802 when the upper and lower housing 1402 and 1404 pivots about the pivot axis 118.

Figure 20:
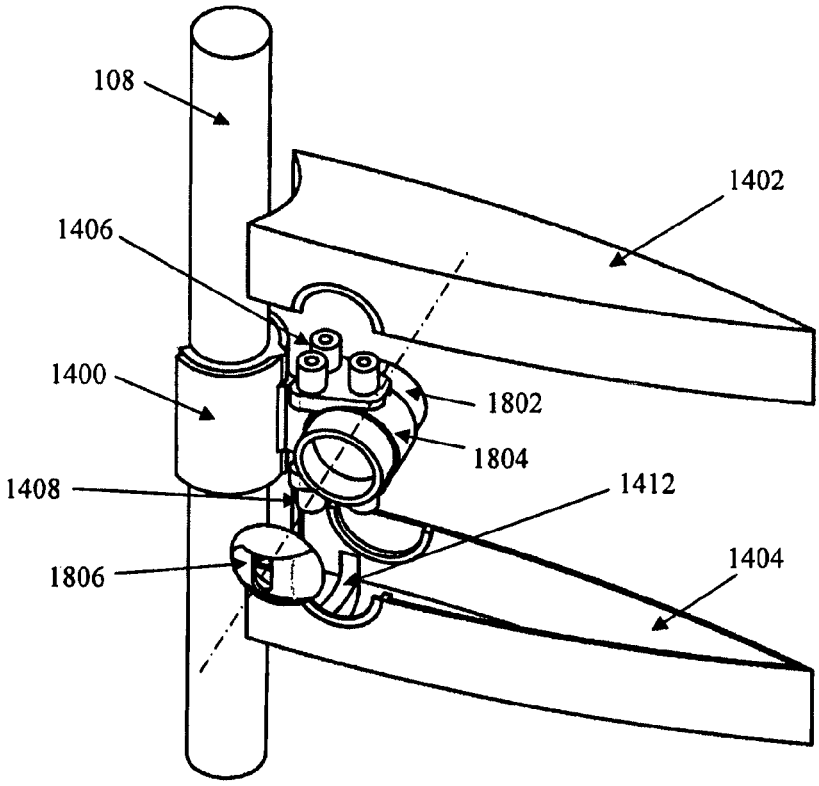
FIGS. 20 and 21 are exploded views of the feedback device shown in FIG. 14.
Figure 21:
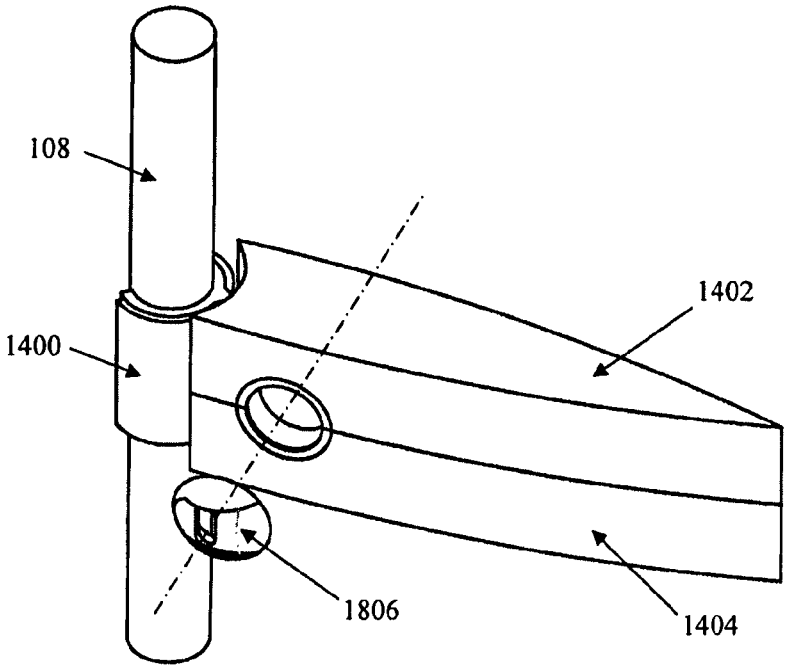

The body 102 shown in FIG. 14 may be assembled by first fitting the barrier member 1804 over the whistle housing 1802. The barrier member 1804 is then fitted to the bracket 1400 so as to engage with each other. The upper and lower positioning embers 1406 and 1408 are fitted to the corresponding regions of the bracket 1400. FIG. 20 shows the body 102 up to this point of the assembly process. The upper and lower housing 1402 and 1404 are then coupled together so that the upper and lower rib portions 1410 and 1412 are received by the upper and lower positioning members 1406 and 1408 respectively. The cap member 1806 is then fitted to the open end portion of the whistle housing 1802, and the cap member 1806 is exposed through a side opening 1418 of the housing 1402 and 1404.

Figure 16:
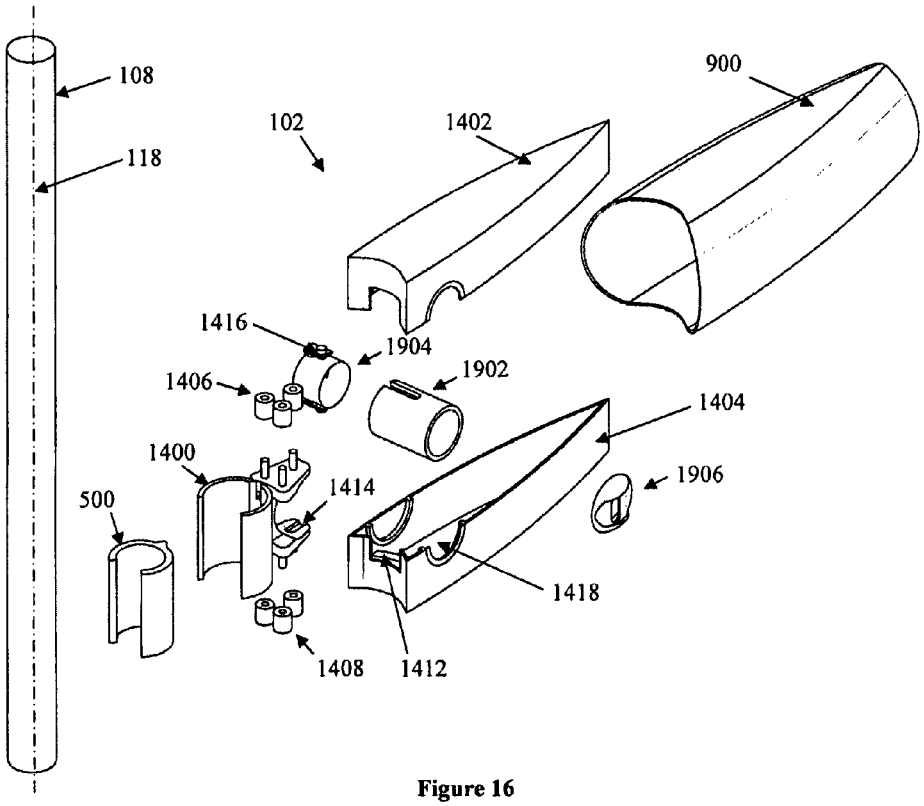
FIG. 16 is an exploded view of another embodiment of the feedback device.
Figure 17:
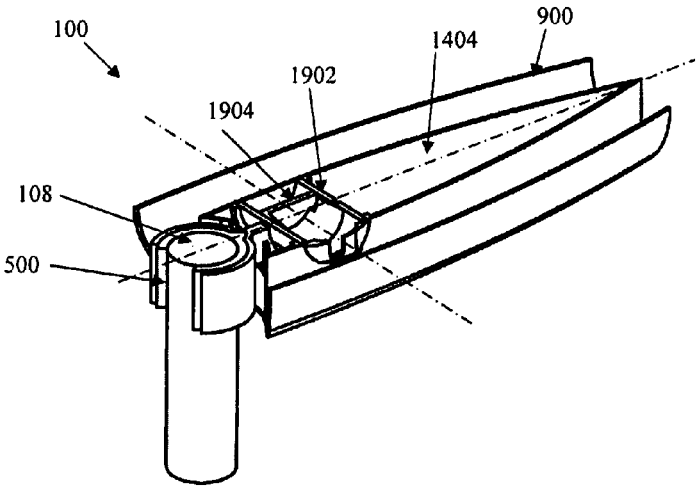
FIG. 17 is a sectional view of the feedback device shown in FIG. 16.

FIGS. 16 and 17 are exploded and sectional views of the components inside another representative embodiment of the body 102. The embodiment shown in FIGS. 16 and 17 has all of the components of the embodiment shown in FIGS. 14 and 15, but has a different adjustable whistle assembly 1900. The adjustable whistle assembly 1900 includes a whistle housing 1902, piston 1904, and cap member 1906. The bracket 1400 is adapted for engaging an actuating portion of the piston 1904.

Figure 18:
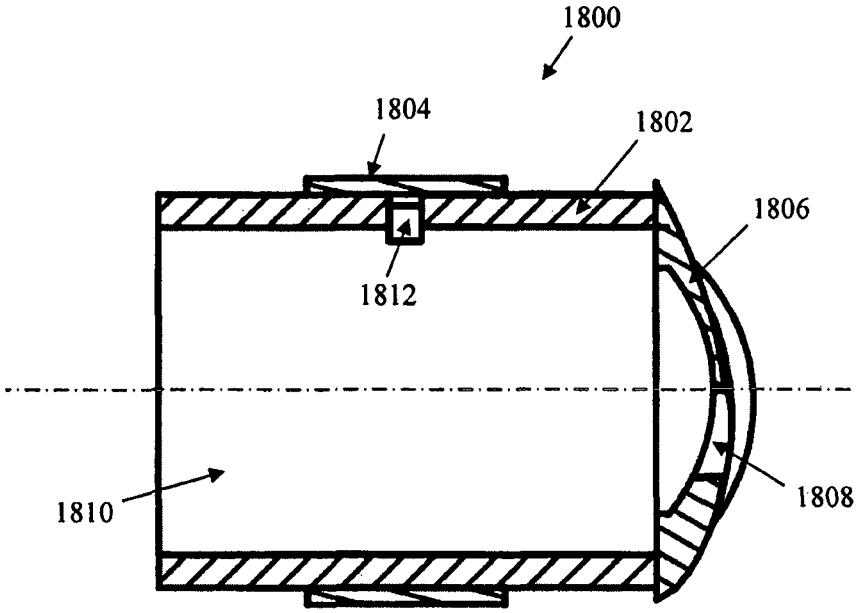
FIG. 18 is a sectional view of one embodiment of a whistle chamber.

FIG. 18 is a sectional view of a representative embodiment of the adjustable whistle assembly 1800 (when assembled). The adjustable whistle assembly 1800 includes a whistle housing 1802, barrier member 1804, and a cap member 1806. The cap member 1806 defines a first opening 1808 for air to access a whistle chamber 1810 within the whistle housing 1802. A second opening 1812 is formed through a side wall of the whistle housing 1802 for air to access the whistle chamber 1810. The second opening 1812 can be covered or exposed depending on the position of the barrier member 1804 relative to the whistle housing 1804. In a representative embodiment, the barrier member 1804 is cylindrical sleeve (or collar) that is able to slide along the outside of the whistle housing 1802.

When the barrier member 1804 covers the second opening 1812, the whistle chamber 1810 defines a fixed volume of space, and only the first opening 1808 provides access to the whistle chamber 1810. In a representative embodiment, when the body 102 travels with the apparatus 104 along a swing path 116, air flows past the first opening 1808 and causes the air proximate to the first opening 1808 to resonate (e.g. based on the Helmholtz resonance effect) thus producing a whistle sound. However, in other representative embodiments, a whistle or other sound(s) may be produced using other acoustic mechanism(s). The barrier member 1804 can move to different positions relative to the whistle housing 1802 based on changes in the offset angle. When the offset angle is within the response angle range, the barrier member 1804 continues to cover the second opening 1812 (so a whistle sound can be produced). However, when the offset angle is outside of the response angle range, the barrier member 1804 moves to a position relative to the whistle housing 1802 such that the second opening 1812 is exposed. In that event, air can escape from the whistle chamber 1810 (which no longer defines a fixed volume) and so the air proximate to the first opening 1808 is unable to resonate in response to air flow. Accordingly, no whistle sound is produced when the second opening 1812 is exposed.

Figure 19:
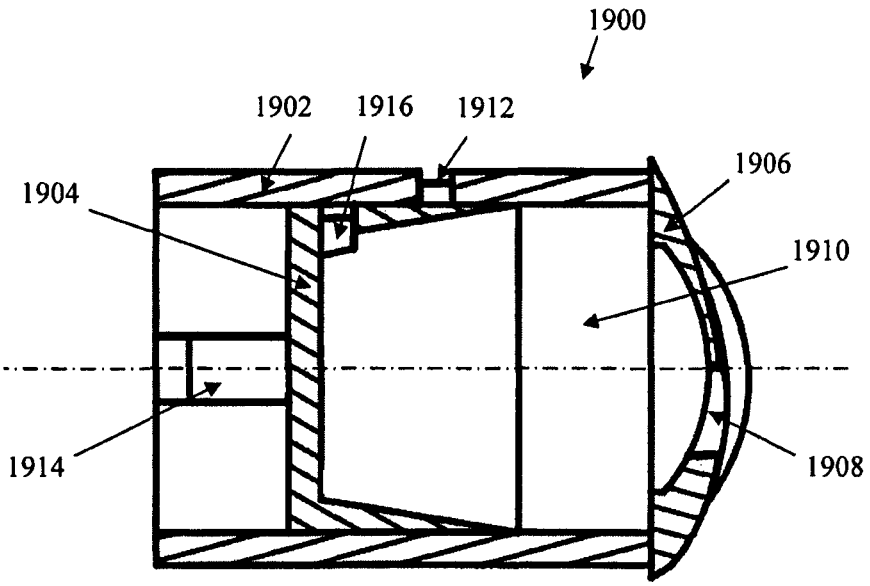
FIG. 19 is a sectional view of another embodiment of a whistle chamber.

FIG. 19 is a sectional view of a representative embodiment of the adjustable whistle assembly 1900 (when assembled). The adjustable whistle assembly 1900 includes a whistle housing 1902, piston 1904, and a cap member 1906. The cap member 906 defines a first opening 1908 for air to access a whistle chamber 1910 within the whistle housing 1902. A second opening 1912 is formed through a side wall of the whistle housing 1902 for air to access the whistle chamber 1912. The piston 1904 is moveable relative to the whistle housing 1902 (e.g. along a guide track 1914 which can also be a recess, channel, slit or groove). The piston 1904 adjusts the volume of space within the whistle chamber 1910 depending on its position relative to the whistle housing 1902. The piston 1904 includes an internal opening 1916. The second opening 1912 can be covered or exposed, depending on the position of the piston 1904 relative to the whistle housing 1902.

When the piston 1904 covers the second opening 1912, the whistle chamber 1910 defines a fixed volume of space, and only the first opening 1908 provides access to the whistle chamber 1910. When the body 102 travels with the apparatus 104 along a swing path 116, air flows past the first opening 1908 and causes the air proximate to the first opening 1908 to resonate (based on the Helmholtz resonance effect) thus producing a whistle sound. The piston 1904 can move to different positions relative to the whistle housing 1902 based on changes in the offset angle. When the offset angle is within the response angle range, the piston 1904 continues to cover the second opening 1912 (so a whistle sound can be produced).

When the offset angle is adjacent to the first threshold angle of the response angle range, the piston 1904 moves towards the cap member 1906, which decreases the volume of space inside the whistle chamber 1910 and enables the air proximate to the first opening 1908 to produce a whistle sound of increasing pitch. However, when the piston 1904 moves too close to the cap member 1906, the internal opening 1916 is aligned with the second opening 1912 to allow air to escape from the whistle chamber 1910 (thus producing no whistle sound).

When offset angle is adjacent to the second threshold angle of the response angle range, the piston 1904 moves away from the cap member 1906 which increases the volume of space inside the whistle chamber 1910 and enables the air proximate to the first opening 1908 to produce a whistle sound of decreasing pitch. However, when the piston 1904 moves too far away from the cap member 1906, the wall of the piston 1904 is no longer able to cover the second opening 1912 and leaves it exposed (thus producing no whistle sound).

FIGS. 22 to 30 are top and sectional views of the feedback device shown in FIG. 14 in different configurations when in use. FIGS. 31 to 39 are top and sectional views of the feedback device shown in FIG. 16 in different configurations when in use.

Figure 22:
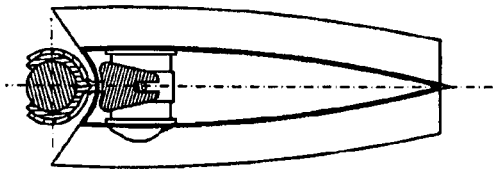
FIGS. 22 to 30 are top and sectional views of the feedback device shown in FIG. 14 in different configurations when in use.
Figure 25:
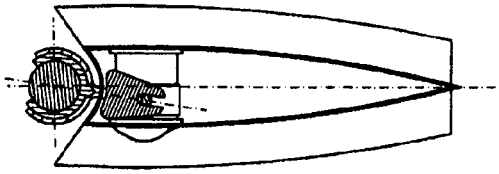
Figure 23:
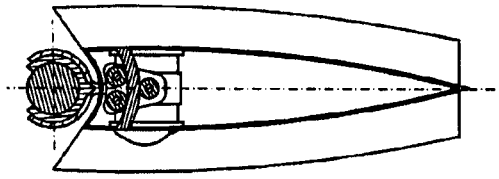
Figure 26:
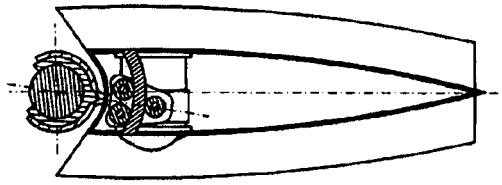
Figure 24:
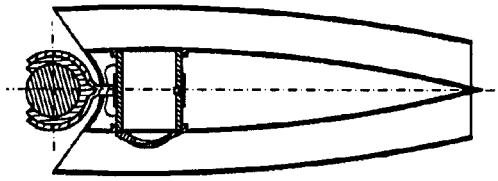
Figure 27:
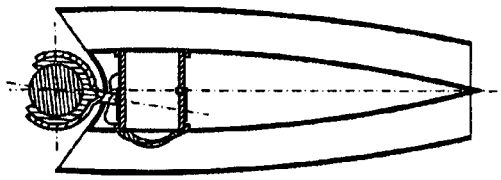
Figure 28:
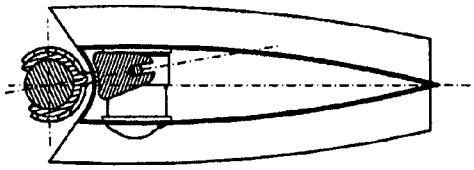
Figure 29:
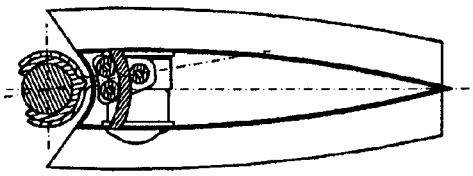
Figure 30:
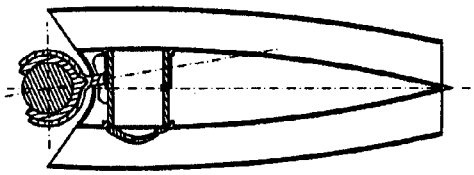
Figure 31:
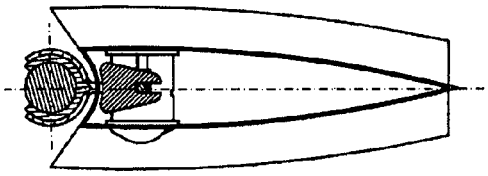
FIGS. 31 to 39 are top and sectional views of the feedback device shown in FIG. 16 in different configurations when in use.
Figure 32:
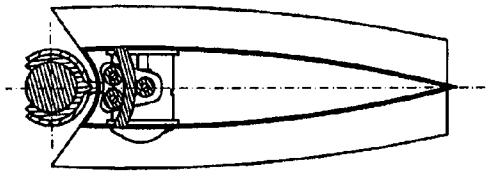
Figure 33:
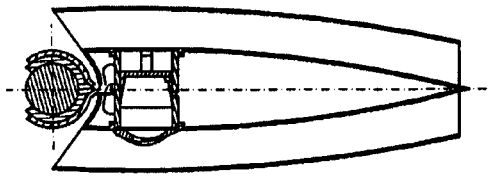
Figure 34:
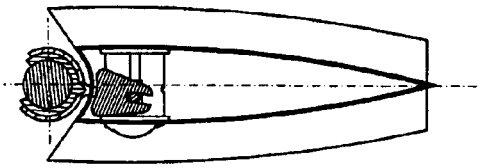
Figure 37:
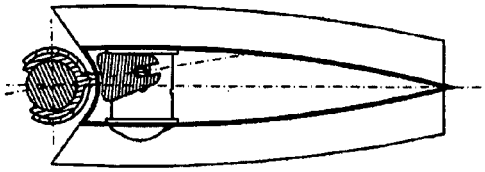
Figure 35:
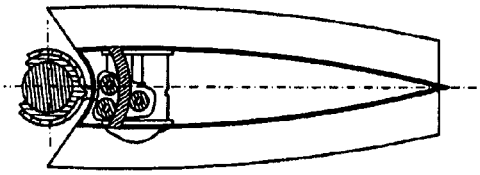
Figure 38:
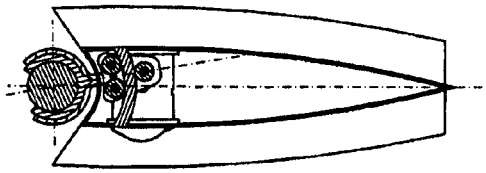
Figure 36:
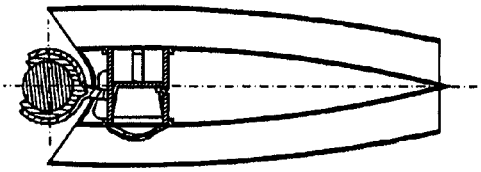
Figure 39:
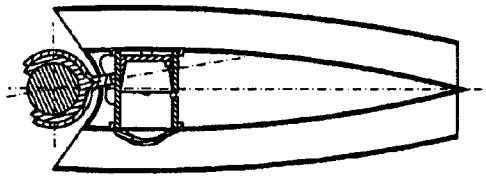

FIGS. 22 to 24 show the body 102 being aligned with (or along) the swing path 116. FIGS. 31 to 33 show the body 102 being aligned with (or along) the swing path 116. In each case, the barrier member 1804 (or piston 1904) covers the respective second opening 1812 and 1912 of the adjustable whistle assembly 1800 and 1900 to produce a whistle sound.

FIGS. 25 to 27 and 34 to 36 show the barrier member 1804 (or piston 1904) moving to one extreme of the response angle range (i.e. close to a first threshold angle), and thus can produce a whistle sound in the case of the adjustable whistle assembly 1800 (or a high pitch whistle sound in the case of the adjustable whistle assembly 1900).

FIGS. 28 to 30 and 37 to 39 show the barrier member 1804 (or piston 1904) moving to the opposite extreme of the response angle range (i.e. close to a second threshold angle), and thus can produce a whistle sound in the case of the adjustable whistle assembly 1800 (or a low pitch whistle sound in the case of the adjustable whistle assembly 1900).

Figure 40:
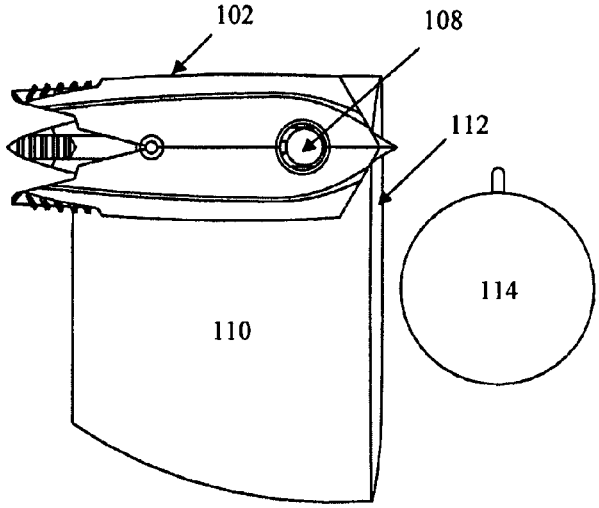
FIG. 40 is a top view of another representative embodiment of the feedback device when coupled to an apparatus.
Figure 41:
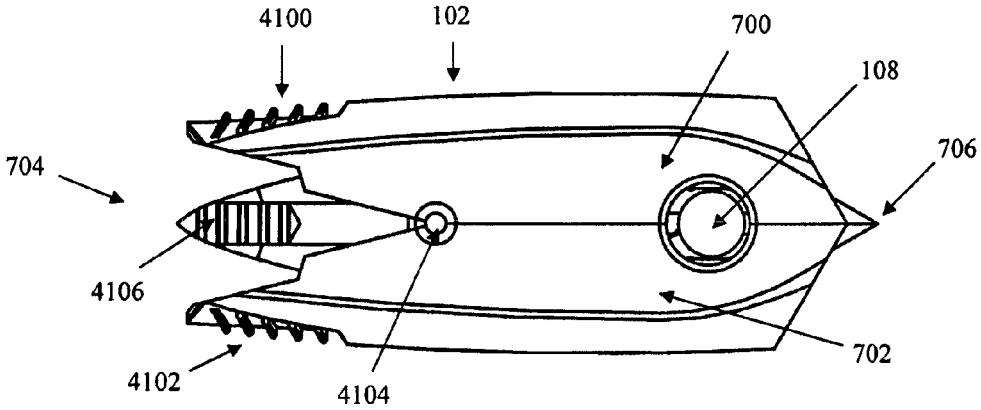
FIG. 41 is a top view of the feedback device shown in FIG. 40.

FIG. 40 is a top view of another representative embodiment of the swing feedback device 100 when coupled to the support portion 108 of a striking apparatus. Similar to the embodiment shown in FIG. 7, the body 102 has an outer sleeve member 900 comprising of two clamp portions 700 and 702 (as shown in FIG. 41). The clamp portions 700 and 702 are biased (e.g. by biasing means not shown in FIG. 40) to move towards each other at the proximate end 706, and each of the clamp portions 700 and 702 have a grip portion 4100 and 4102 at the distal end 704. When the grip portions 4100 and 4102 move towards each other at the distal end 704 (e.g. in response to force exerted by a user), the clamp portions 700 and 702 pivot about a pivot axis 4104 and move away from each other at the proximate end 706. This enables the components of the body 102 (e.g. the bracket 1400 shown in FIG. 42) to engage with the support portion 108 of the striking apparatus (e.g. via a collar 500 attached to the support portion 108 of the apparatus).

Figure 42:
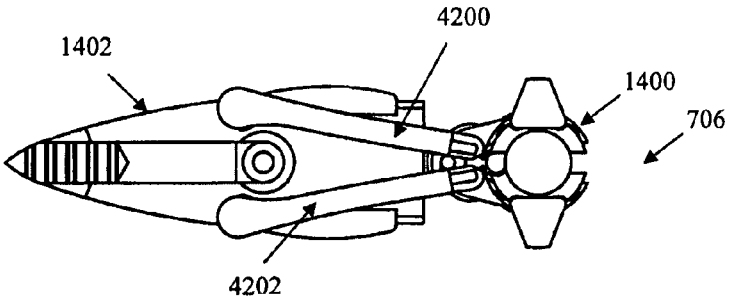
FIG. 42 is top view of the pivoting mechanism in the device shown in FIG. 40.

FIG. 42 shows some of the components inside another representative embodiment of the body 102, which includes an improved pivoting mechanism for connecting the housing 1402 and 1404 of the body to the bracket 1400. The bracket 1400 shown in FIG. 42 performs the same function as the bracket 1400 described with reference to FIG. 14, but achieves this in a mechanically simpler way (i.e. has less parts, uses a simpler mechanical coupling arrangement, and offers lower frictional resistance in comparison to the pinion set embodiment described with reference to FIGS. 14, 16 and 20). In the representative embodiment shown in FIG. 42, two clips 4200 and 4202 have one end adapted to be coupled to the bracket 1400 for pivot rotation about different respective pivot axes. The other end of the clips 4200 and 4202 are adapted to be coupled for pivot rotation relative to the housing 1402 and 1404 of the body 102.

Figure 43:
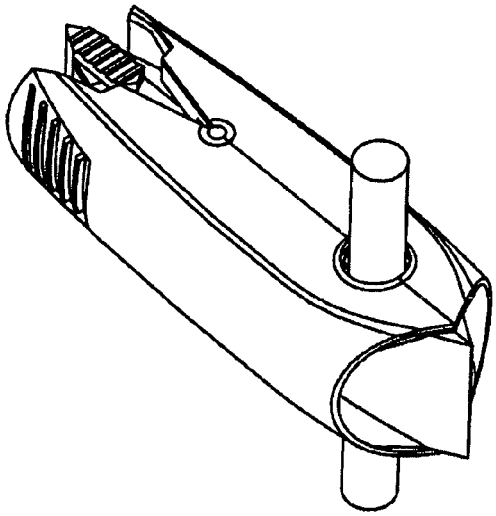
FIG. 43 is a perspective view of the feedback device shown in FIG. 40.
Figure 44:
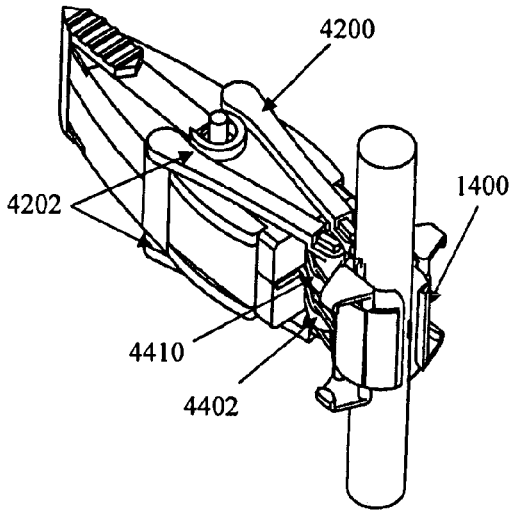
FIG. 44 is a perspective view of the pivoting mechanism shown in FIG. 42.
Figure 45A:
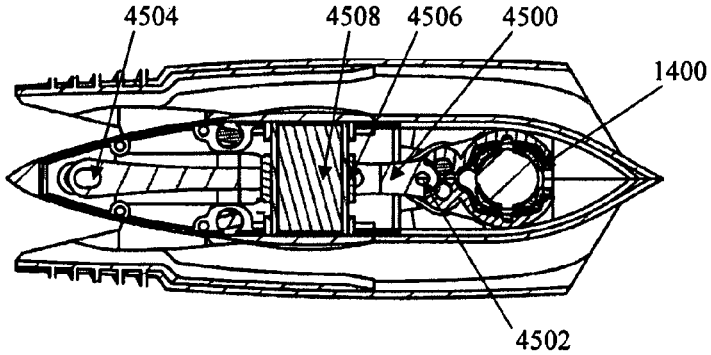
FIG. 45A is a length-wise sectional view of a mechanical embodiment of the feedback device.
Figure 45B:
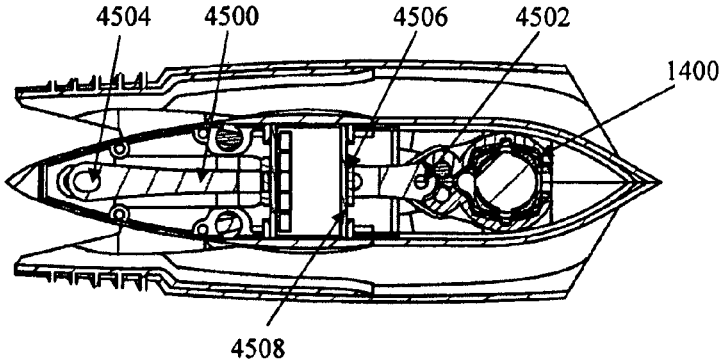
FIG. 45B is a length-wise sectional view of a combined mechanical and electrical embodiment of the feedback device.

FIG. 43 is a perspective view of the device 100 (when assembled with the sleeve member 900) in a first configuration (similar to that shown in FIG. 2) where the longitudinal axis of the body 102 is substantially perpendicular to the strike face 112 (not shown in FIG. 43). FIG. 44 is a perspective view of the components of the device 100 (with the sleeve member 900 removed) when placed in the first configuration. Two springs (shown by arrows 4400 and 4402) help secure the clips 4200 and 4202 on the bracket 1400. FIG. 45A is a sectional view (along the longitudinal axis of the body 102) of a mechanical embodiment of the device 102 when configured in the first configuration. FIG. 45B is a sectional view (along the longitudinal axis of the body 102) of an electro-mechanical embodiment of the device 102 when configured in the first configuration.

Figure 46:
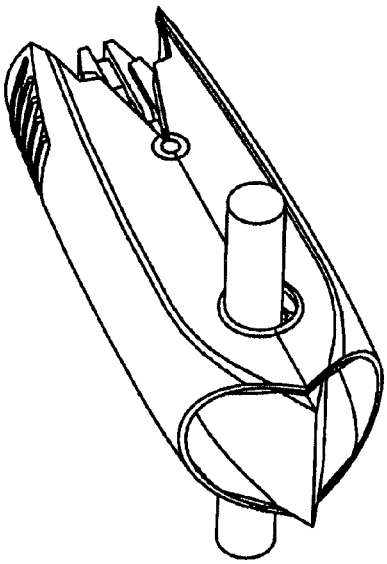
FIGS. 46, 47 and 48 are perspective and sectional views of the feedback device (when rotated relative to the apparatus) corresponding to FIGS. 43, 44 and 45.
Figure 47:
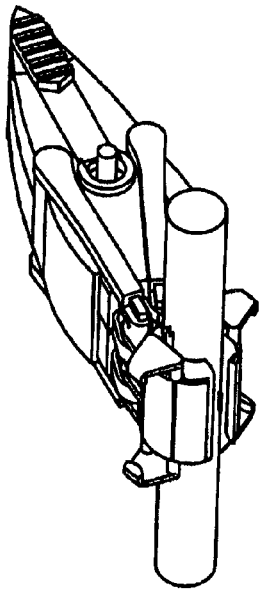
Figure 48:
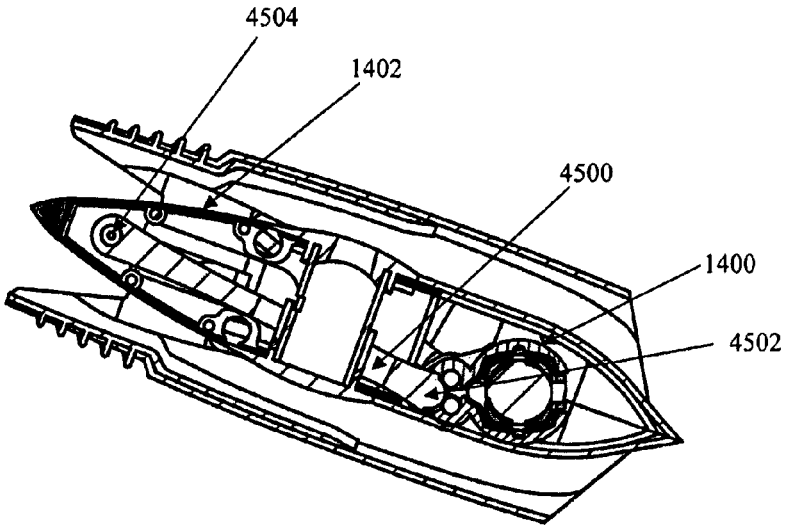

FIG. 46 is a perspective view of the device 100 (when assembled with the sleeve member 900) in a second configuration (similar to that shown in FIG. 4) where the longitudinal axis of the body 102 is offset from a perpendicular axis from the strike face 112 (not shown in FIG. 46). FIG. 48 is a sectional view (along the longitudinal axis of the body 102) of the mechanical embodiment of the device 102 shown in FIGS. 43, 44 and 45A.

The representative embodiments of the device 102 shown in FIGS. 45A, 45B and 48 include a single control arm 4500. A proximate end 4502 of the control arm 4500 is pivotally coupled to the bracket 1400, while a distal end 4504 of the control arm 4500 is pivotally coupled to the housing 1402 and 1404. A middle section of the control arm 4500, which is intermediate the proximate and distal ends 4502 and 4504, engages a first component 4506 (e.g. a barrier member 1804, magnet or light source) and adjusts the position of the first component 4506 relative to a second component 4508 (e.g. a whistle housing 1802, Hall effect sensor, magnetic reed switch or light sensor) whereby the relative position between the first and second components 4506 and 4508 determines the type of auditory feedback to be produced by the device 100.

The embodiments shown in FIGS. 40 to 44 and 47 all include a sliding lock button 4106. When the lock button 4106 is pushed towards the proximate end 706, the lock button 4106 engages with other internal components of the body 102 (not shown in FIG. 41) and causes them to form a frictional or interlocking engagement with each other to resist further movement of the body 102 relative to the support portion 108 from its current position. In a representative embodiment, the sliding lock button 4106 can only be configured to move towards the proximate end 706 when the device 100 is placed in the first configuration as shown in FIGS. 2, 43 and 44.

Figure 49:
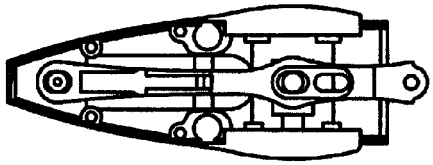
FIGS. 49 to 54 are sectional and perspective views of the components in a representative mechanical pitch varying embodiment of the feedback device.
Figure 52:
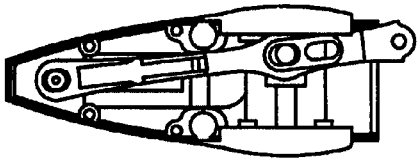
Figure 50:
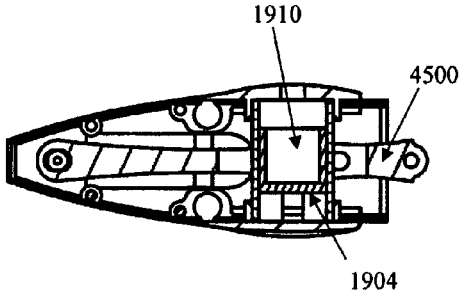
Figure 53:
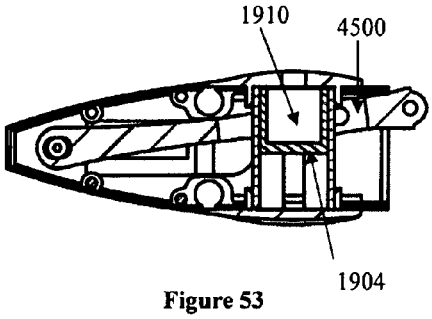
Figure 51:
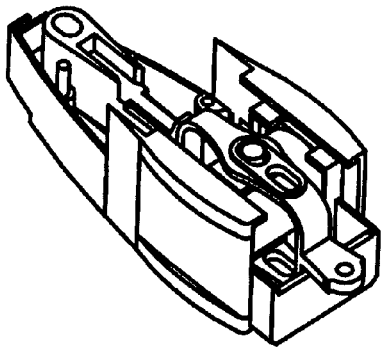
Figure 54:
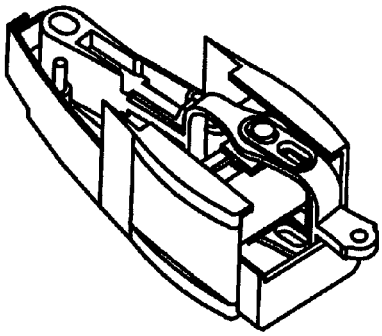

FIGS. 49 to 54 are sectional and perspective views of the components in a representative mechanical pitch-varying embodiment of the device 100. FIGS. 49 to 51 show the device 100 in a first configuration for producing auditory feedback. FIGS. 52 to 54 show the device in a second configuration for producing auditory feedback of higher pitch. When the body 102 moves from the first configuration to the second configuration, the control arm 4500 (together with the piston 1904 connected the control arm 4500) moves from the configuration shown in FIG. 50 to that shown in FIG. 53. This reduces the volume of the whistle chamber 1910 and causes the whistle to produce a higher pitch sound. Although not shown in the FIGS. 49 to 54, it will be understood that the control arm 4500 and piston 1904 can be configured to increase the volume of the whistle chamber 1910 (i.e. opposite to the configuration shown in FIG. 53) to produce a lower pitch sound.

The representative embodiments described with reference to FIGS. 55 to 75 relate to an body 102 that is configurable between "on" and "off" auditory feedback states, that is, to either produce auditory feedback or no such feedback at all.

Figure 55:
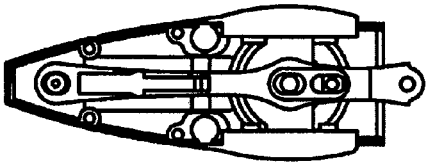
FIGS. 55 to 60 are sectional and perspective views of another representative mechanical embodiment of the feedback device.
Figure 58:
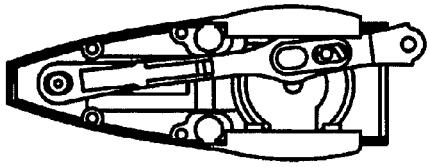
Figure 56:
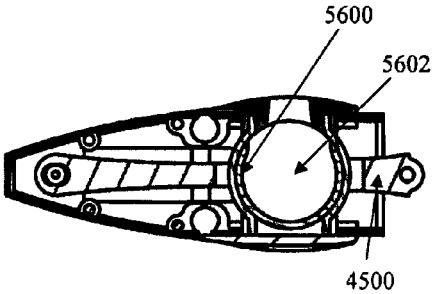
Figure 59:
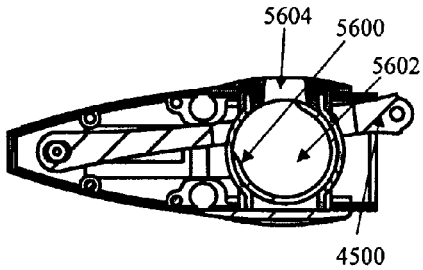
Figure 57:
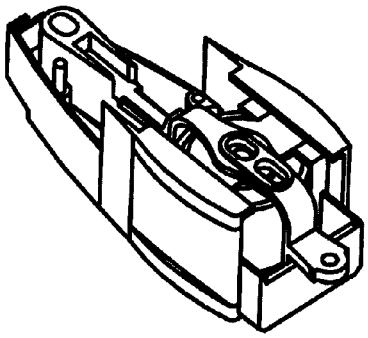
Figure 60:
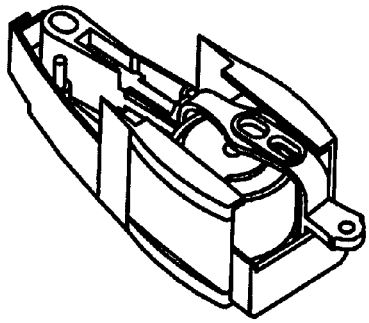

FIGS. 55 to 60 are sectional and perspective views of another representative mechanical embodiment of the device 100. FIGS. 55 to 57 show the device 100 in a first configuration for producing auditory feedback. FIGS. 58 to 60 show the device 100 in a second configuration for inhibiting the production of auditory feedback. When the body 102 moves from the first configuration to the second configuration, the control arm 4500 moves from the configuration shown in FIG. 56 to that shown in FIG. 59. This rotates an arcuate lip member 5600 (which is rotatably fitted inside the whistle chamber 5602) to a position that enable the lip member 5600 to block, inhibit, resist or interfere with the flow of air into the whistle chamber 5602 through the opening 5604 (see FIG. 59), and thus inhibit the whistle from producing audible feedback.

Figure 61:
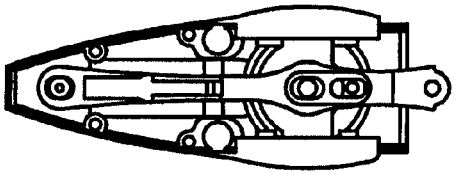
FIGS. 61 to 66 are sectional and perspective views of another representative mechanical embodiment of the feedback device.
Figure 64:
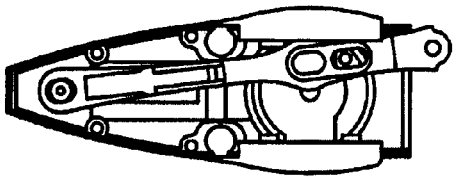
Figure 62:
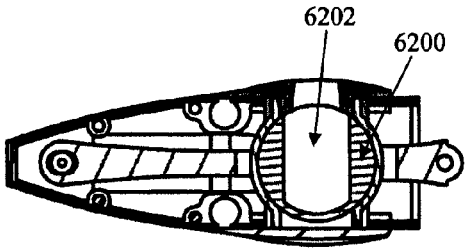
Figure 65:
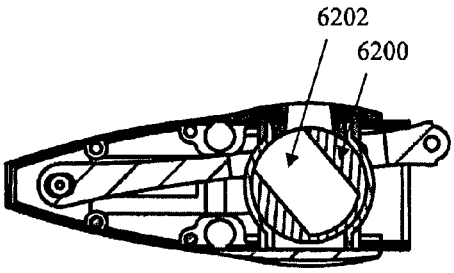
Figure 63:
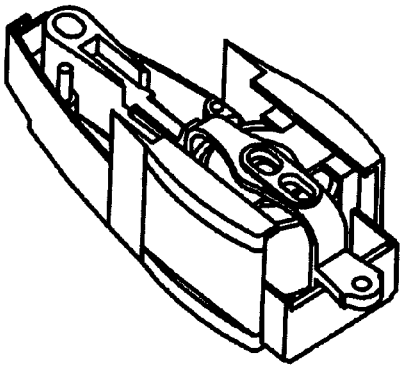
Figure 66:
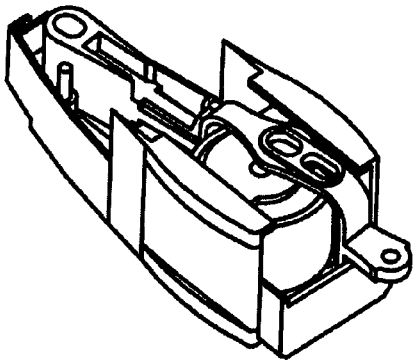

FIGS. 61 to 66 are sectional and perspective views of another representative mechanical embodiment of the device 100. FIGS. 61 to 63 show the device 100 in a first configuration for producing auditory feedback. FIGS. 64 to 66 show the device 100 in a second configuration for inhibiting the production of auditory feedback. This embodiment operates in the same manner as the embodiment described with reference to FIGS. 55 to 60, except that the lip member 6200 is shaped to define a whistle chamber 6202 with a consistent cylindrical cross-sectional shape.

Figure 67:
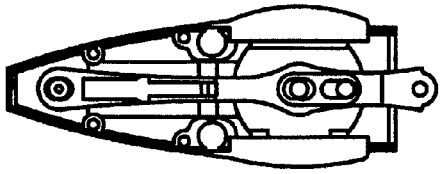
FIGS. 67 to 72 are sectional and perspective views of another representative mechanical embodiment of the feedback device.
Figure 70:
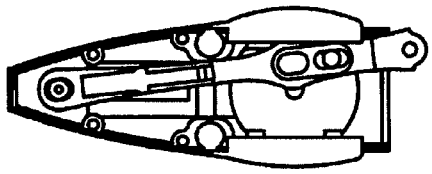
Figure 68:
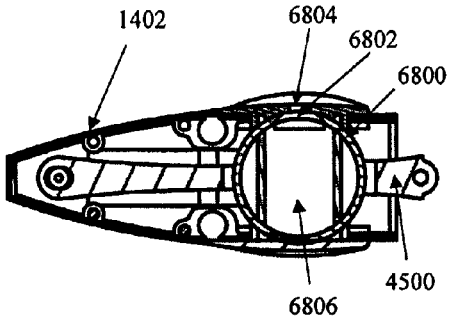
Figure 71:
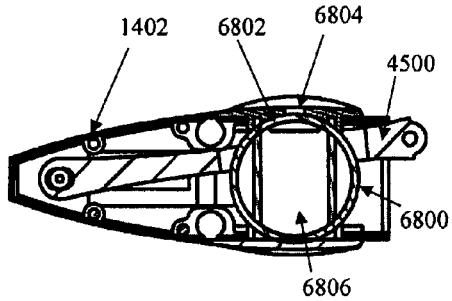
Figure 69:
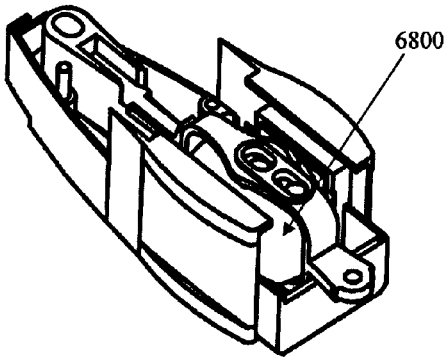
Figure 72:
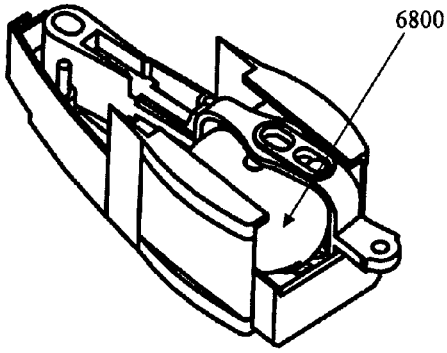
Figure 73:
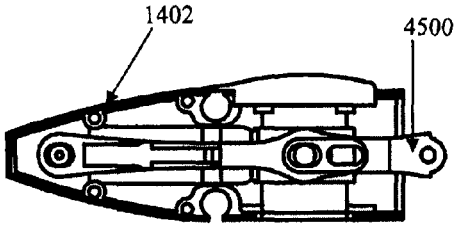
FIGS. 73 to 78 are sectional and perspective views of a representative electro-mechanical embodiment of the feedback device.
Figure 76:
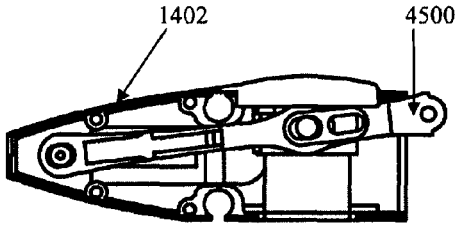
Figure 74:
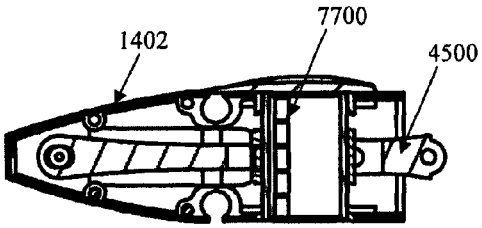
Figure 77:
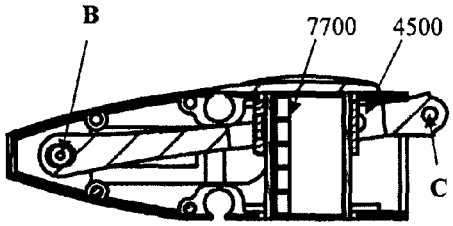
Figure 75:
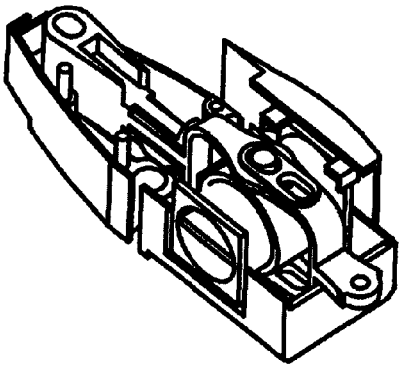
Figure 78:
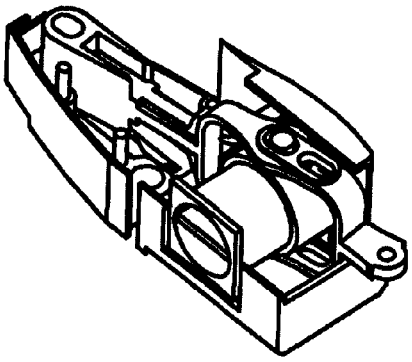

FIGS. 67 to 72 are sectional and perspective views of another representative mechanical embodiment of the device 100. FIGS. 67 to 69 show the device in a first configuration for producing auditory feedback. FIGS. 58 to 60 show the device in a second configuration for inhibiting the production of auditory feedback. This embodiment operates in the similar manner to the embodiment described with reference to FIGS. 55 to 60. When the body 102 moves from the first configuration to the second configuration, the control arm 4500 moves from the configuration shown in FIG. 68 to that shown in FIG. 71. This rotates the whistle housing 6800 relative to the housing 1402 and 1404, which blocks, inhibits, resists or interferes with the flow of air into the whistle chamber 6806 through the whistle opening 6804 (see FIG. 71), and thus inhibits the whistle from producing audible feedback.

In a representative embodiment, the swing feedback device 100 may include one or more electrical and/or electro-mechanical sensors for detecting a position of the body 102 relative to the support portion 108 of the apparatus. The sensors generates swing data (e.g. representing one or more data values, signals, parameters, commands and/or instructions) which includes at least a detected position of the body 102 relative to the support portion 108. For example, an electrical sensor may include one or more optical sensors, magnetic sensors, shaft encoders, linear position sensors, displacement sensors (e.g. linear variable differential transformer (LVDT)), accelerometers, gyroscopes, tilt position sensors and/or mercury sensors. More specifically, the swing data generated by these various electrical or electro-mechanical sensors may include one or more of:

i) data representing a swing velocity of the apparatus 104 moving with said body. 102 along the swing path 116, or more specifically the velocity of the strike face 116 during a swing by the user;

ii) data representing a position on the strike face 116 that is impacted by the object 114 during the swing path 116;

iii) data representing a swing plane angle, representing an angular deviation from the intended swing path 116, of the apparatus 104 during the swing path 116; or iv) data representing the swing frequency of the apparatus 104, such as, for example, during a round of play.

FIGS. 73 to 78 are sectional and perspective views of a representative embodiment of the device 100 incorporating one or more electro-mechanical sensors. The device 100 shown in FIGS. 73 to 78 has similar mechanical components to the embodiments shown in FIGS. 49 to 72. In one embodiment, a rotary-style sensor is positioned at joints B and C of FIG. 77 for detecting a degree of rotational displacement of the control arm 4500 relative to the housing 1402 and 1404 of the body 102. In another embodiment, the one or more sensors 7700 (which are held in a fixed position relative to the housing 1402 and 1404) are arranged for detecting a linear displacement of a predetermined portion of the control arm 4500 (see FIGS. 74 and 77). For example, the sensors 7700 may include one or more Hall Effect sensors, magnetic reed switches, linear potentiometers, mechanical contact switches, optical-based position detection sensors, and/or encoders.

Figure 79:
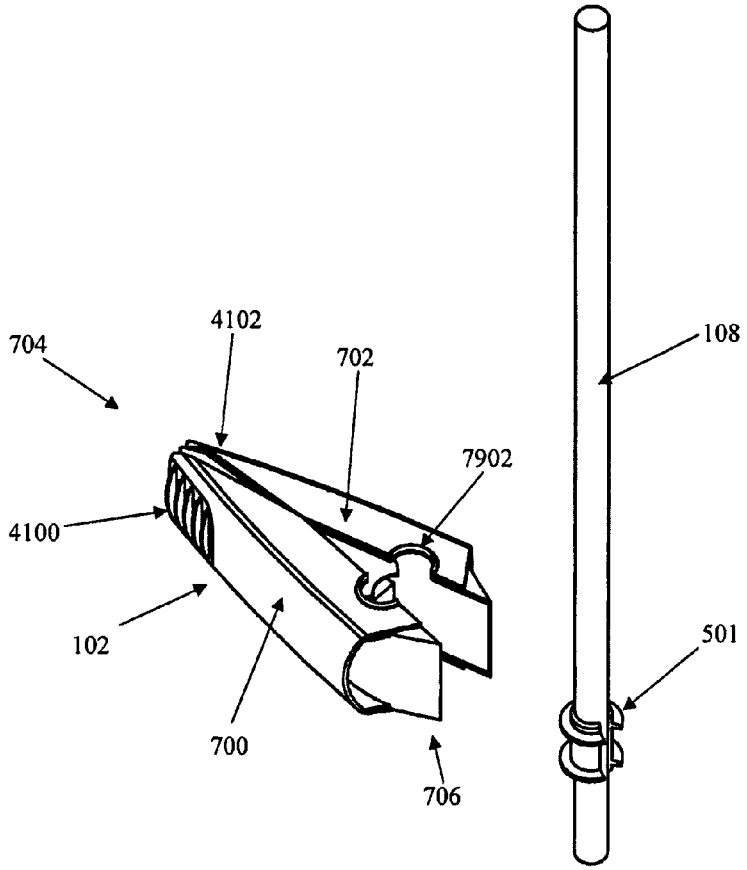
FIGS. 79 to 81 are sectional and perspective views of another representative electro-mechanical embodiment of the feedback device.
Figure 80:
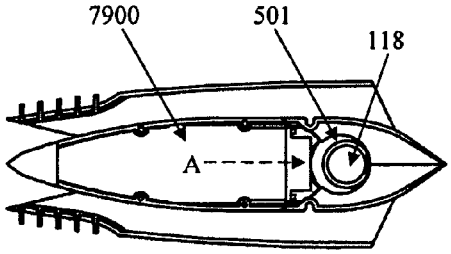
Figure 81:
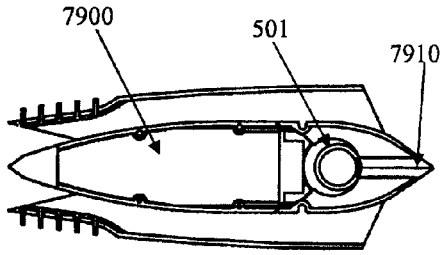

FIGS. 79 to 81 are sectional and perspective views of another representative embodiment of the device 100 incorporating one or more electro-mechanical sensors. Similar to the embodiment shown in FIG. 41, the body 102 has an outer sleeve member 900 comprising of two clamp portions 700 and 702. The clamp portions 700 and 702 are biased (e.g. by biasing means not shown in FIGS. 79 to 81) to move towards each other at the proximate end 706, and each of the clamp portions 700 and 702 have a grip portion 4100 and 4102 at the distal end 704. When the grip portions 4100 and 4102 move towards each other at the distal end 704 (e.g. in response to force exerted by a user), the clamp portions 700 and 702 pivot about a pivot axis 4104 (not shown in FIGS. 79 to 81) and move away from each other at the proximate end 706. This enables the components of the body 102 (e.g. the connecting bracket 7902 shown in FIG. 79) to engage with the support portion 108 of the striking apparatus (e.g. via a collar 501 attached to the support portion 108 of the apparatus).

In one embodiment (shown in FIGS. 80 and 81), an optical sensor 7900 (which is held in a fixed position relative to the body 102) is arranged in the direction of arrow A for detecting a position of a reference marker 7904 (not shown in FIGS. 79 to 81) located on the collar 501. The reference marker 7904 is fixed relative to the strike face 112 (not shown in FIGS. 79 to 81) by attachment of the collar 501 to the support portion 108 in a suitable rotational orientation about the support portion 108. When the user swings the apparatus 104 with the device 100 attached, the relative position of the reference marker 7904 and the optical sensor 7900 is determined based on an offset angle formed between the strike face 112 and the body 102 on a plane perpendicular to the pivot axis 118 (not shown in FIGS. 79 to 81).

While this embodiment of the invention has been described with reference to an optical sensor 7900, it should be understood that alternative sensors may include one or more Hall Effect sensors, magnetic reed switches, linear potentiometers, mechanical contact switches, optical-based position detection sensors, and/or encoders.

In a representative embodiment of the invention shown in FIG. 81, the proximate end 706 of the body 102 also includes a vent 7910 that inwardly communicates with an annular space between the connecting bracket 7902 and the collar 501. When the user swings the apparatus 104 with the device 100 attached, pressurised air is forced through the vent 7910 and into the annular space between the connecting bracket 7902 and the collar 501, this pressurised air acting to reduce the frictional coefficient between the connecting bracket 7902 and collar 501 and improve (and stabilize) the alignment of the body 102 with the swing path 116. It should be understood that the pressured air results from the aerodynamic shape of the vent 7910, and the relative speed at which the body 102 travels when attached to the apparatus 104 and moving along the swing path 116.

The swing data generated by the sensors may be processed by an analysis module 8210 for electronically generating audible feedback in real time (e.g. within approximately 50 microseconds). In accordance with a particularly preferred embodiment of the present invention, both the analysis module 8210 and the sound generator 8216 are located within the body 102 of the device 100 that is attached to the support portion 108 of the apparatus 104, such that auditory feedback can be provided to the user in the shortest possible time. However, the analysis module 8210 may also transmit the information represented by the swing data to an external processing system (e.g. a gaming system, computer, mobile phone or other mobile computing device) for processing. Alternatively, the analysis module 8210 may be located external to the body 102 of the device 100 such as, for example, on an external peripheral device (not shown). These features are described in more detail with reference to FIG. 82.

Figure 82:
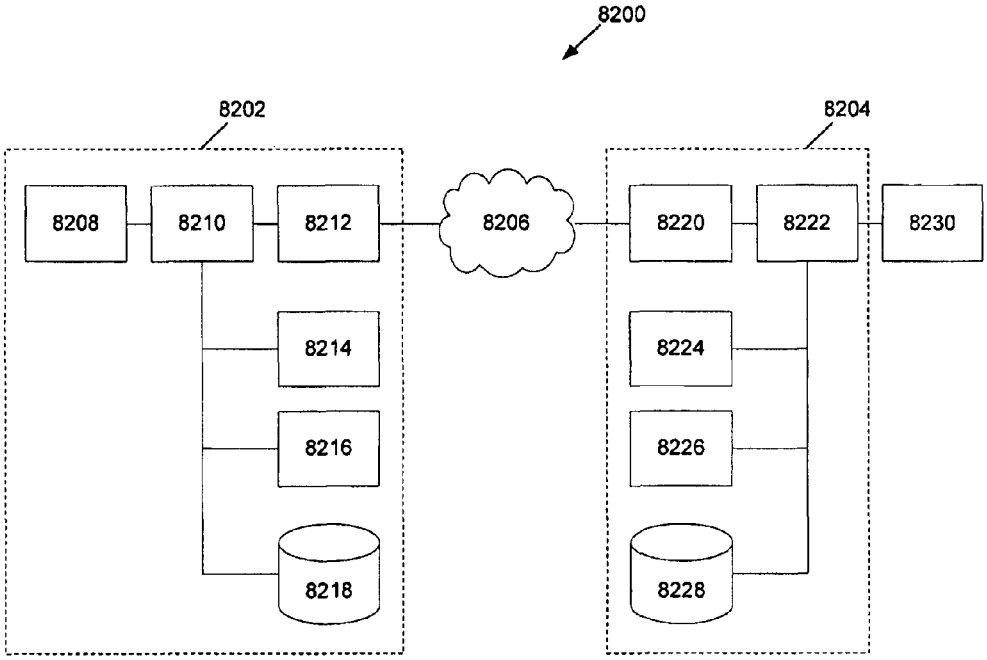
FIG. 82 is a block diagram of a swing training and control system.

FIG. 82 is a block diagram of a swing training and control system 8200. In a representative embodiment, the system 8200 includes a swing feedback system 8202 that communicates with an external processing system 8204 via a communications link, interface or network 8206 (e.g. such as a wired connection, Bluetooth or other radio link, IEEE 802.11a/b/g/n network, the Internet or mobile telecommunications network). In another representative embodiment, the system 8200 only consists of the swing feedback system 8202, the components of which may be provided as part of the swing feedback device 100, and/or the apparatus to which the device 100 is connected.

The swing feedback system 8202 includes one or more electrical and/or electro-mechanical sensors 8208 of the type described above. The sensors generate swing data (as described above) for an analysis module 8210. The analysis module 8210 then processes the swing data to perform one or more of the following functions:

generate, based on the swing data, audio data representing an audio signal for a line out component 8214 (e.g. a socket for transmitting audio signals to a headphone);

generate, based on the swing data, audio data representing an audio signal for a sound generator 8216 (e.g. an electroacoustic transducer, audio speaker or piezoelectric audio device); and generate results data, including the swing data and other ancillary or session specific data (e.g. representing a date, practice session identifier, device sensitivity, rank, score and/or rating), and store the results data into a data store 8218. The data store 8218 can include any means of data storage, including flash memory.

The analysis module 8210 may perform processing under the control of one or more commands, code, parameters and/or instructions stored in the data store 8218. For example, the analysis module 8210 may perform processing based on configuration data stored in the data store 8218, which represents one or more configuration parameters (e.g. the response angle range for the device, and calibration and sensitivity settings for the sensors of the device 100) for use by the analysis module 8210 to configure the operation of the device 100. In a representative embodiment, the configuration data may be transmitted td the transmitter/receiver 8212 from an external device, which is then used to configure or control the processing performed by the analysis module 8210.

In another representative embodiment, the analysis module 8210 generates, based on the swing data, signal data for a transmitter/receiver 8212 to transmit to the external processing system 8204 for processing. The signal data may include control data as well as data representing the swing data. The signal data is received by the transmitter/receiver 8220 of the external processing system 8204, and is passed to the processing module 8222 for processing. The processing module 8222 extracts the swing data from the signal data, and processes the swing data to perform one or more of the following functions:

generate, based on the swing data, audio data representing an audio signal for a line out component 8224 (e.g. a socket for transmitting audio signals to a headphone);

generate, based on the swing data, audio data representing an audio signal for a sound generator 8226 (e.g. an electroacoustic transducer, audio speaker or piezoelectric audio device);

generate results data, including the swing data and other ancillary data (e.g. representing a date, time, practice session identifier, device sensitivity, rank, score and/or rating), and store the results data into a data store 8228 (or other remote database). The data store 8228 can includes any means of data storage, e.g. flash memory. This is useful where the external processing system 8204 is part of a computer device (e.g. a personal computer or smart mobile phone) that is configured to provide training functions for a user (e.g. for providing feedback to a user's swing in realtime, store and retrieve the results of consecutive swings to provide a training record for review and correction, and perform detailed analysis of the user's swing technique);

generate, based on the swing data, control data for manipulating the position, movement or other characteristics a user interface component (e.g. a pointer, cursor, character, avatar or item) that is displayed to a user via a display 8230. This is useful where the external processing system 8204 is gaming device.

In a representative embodiment, the audio data produced by the analysis module 8210 or processing module 8222 represents an audio signal with similar characteristics as the auditory feedback produced by the mechanical embodiments of the device as described above. For example, the device may be configured to (i) produce sound of varying pitch based on the degree of rotation between the body 102 and support portion 108, (ii) produce a first type of auditory feedback (e.g. sound of a particular pitch) when the device 100 is positioned at an offset angle that is within (or alternatively outside of) a predetermined response angle range, or (iii) produce a second type of auditory feedback (e.g. sound of a different pitch) when the device 100 is positioned at an offset angle that is outside of (or alternatively within) a predetermined response angle range.

Figure 83:
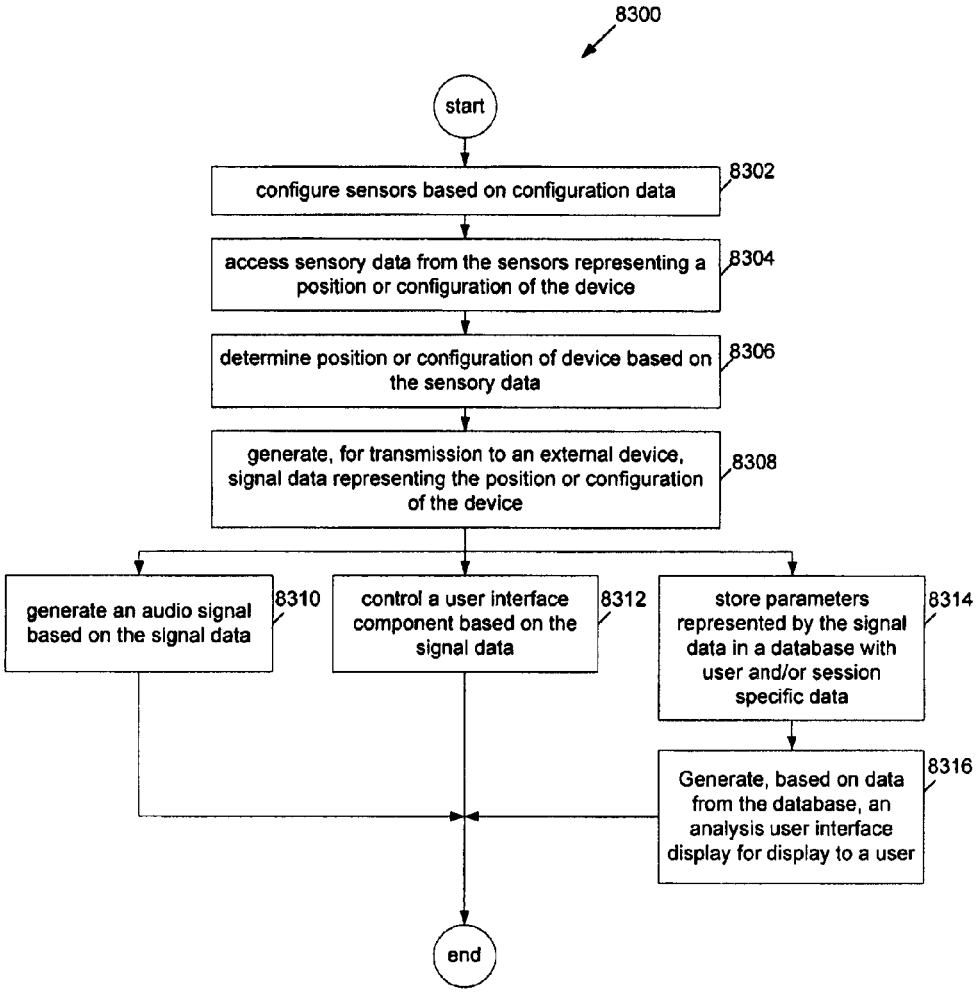
FIG. 83 is a flow diagram of the processing steps performed by the system.

FIG. 83 is a flow diagram of a control and feedback process 8300. Steps 8302 to 8308 are performed under the control of one or more processors of the analysis module 8210. One or more of steps 8310 to 8314 are selectively performed (e.g. depending on the type of functionality to be provided by the external processing system 8204) under the control of one or more processors of the processing module 8222. The analysis module 8210 and processing module 8222 may be provided by computer program code (e.g. in languages such as C and Assembly). Those skilled in the art will appreciate that the processes performed by the analysis module 8210 and processing module 8222 can also be executed at least in part by dedicated hardware circuits, e.g. Application Specific Integrated Circuits (ASICs) or Field-Programmable Gate Arrays (FPGAs).

FIGS. 84 and 85 are perspective views of another representative embodiment of the device 100 incorporating one or more electro-mechanical sensors. Similar to the embodiment shown in FIGS. 79 to 81, the body 102 comprises two clamp portions 8400 and 8402. The clamp portions 8400 and 8402 are biased (e.g. by biasing means not shown in FIGS. 84 and 85) to move towards each other at the proximate end 8406, and each of the clamp portions 8400 and 8402 have a grip portion 8500 and 8502 at the distal end 8404. When the grip portions 8500 and 8502 move towards each other at the distal end 8404 (e.g. in response to force exerted by a user, such as shown in FIG. 84), the clamp portions 8400 and 8402 pivot about a pivot axis (not shown in FIGS. 84 and 85) and move away from each other at the proximate end 8406. This enables the body 102 to be attached to the striking apparatus, by positioning clamps 8410 and 8412 around the support portion 108 of the striking apparatus. The force can then be withdrawn from grip portions 8500 and 8502, allowing the grip portions 8500 and 8502 to move away from each other at the distal end 8404 (such as shown in FIG. 85), and allowing the clamp portions 8400 and 8402 to pivot about a pivot axis (not shown in FIGS. 84 and 85) and move towards each other at the proximate end 8406, such that the clamps 8410 and 8412 engage the support portion 108.

In one embodiment of the present invention, attachment of the body 102 to the support portion 108 requires the body 102 to be pivotally aligned within a predefined tolerance angle range about a plane (not shown in FIGS. 84 and 85) extending perpendicular to the strike face 112 of the apparatus 104. The predefined tolerance angle range extends rearward of the strike face and comprises a deviation either side of the plane of between about 20 to about 45 degrees. Once the body 102 is attached to the support portion 108 of the apparatus 104, the pivotal alignment of the body 102 (relative to the strike face 112) does not alter to any substantial degree during travel of the strike face 112 along the swing path 116.

In accordance with this embodiment of the invention (shown, at least, in FIGS. 84 and 85), the body 102 houses internal sensors (e.g. gyroscopes and/or accelerometers) that generate, in real time (e.g. within approximately 50 microseconds), swing data during travel of the strike face 112 along the swing path 116. This swing data includes, but is not limited to, an offset angle formed between the strike face 112 and the swing path 116 during travel of the strike face 112 along the swing path 116, and particularly the offset angle formed between the strike face 112 and the swing path 116 at the moment of impact between the strike face 112 and the object 114.

Modifications and improvements to the invention will be readily apparent to these skilled in the art. Such modifications and improvements are intended to be within the scope of this invention. For example, although the representative embodiment described herein illustrate example of the device 100 for producing sound (of a single or varying pitch) when the body 102 moves within a response angle range, it will be understood that simple modifications can be made to these examples so that no sound is produced when the body 102 moves within a response angle range but sound (of a single or varying pitch) is produced when the body 102 moves outside of the response angle range.

The word 'comprising' and forms of the word 'comprising' as used in this description and in the claims does not limit the invention claimed to exclude any variants or additions.

In this specification, including the background section, where a document, act or item of knowledge is referred to or discussed, this reference or discussion is not an admission that the document, act or item of knowledge or any combination thereof was at the priority date, publicly available, known to the public, part of common general knowledge, or known to be relevant to an attempt to solve any problem with which this specification is concerned.

The invention claimed is:

1. A swing feedback device, including:

(a) a body attachable to an apparatus, said apparatus having a strike face moveable by a user along a swing path for striking an object, said body being pivotable about an axis that extends along a support portion of said apparatus;

(b) one or more sensors attached to said body, said sensors being adapted to generate swing data including an offset angle formed between said strike face and said swing path during travel of said strike face along said swing path; and (c) a sound generator for generating auditory feedback for said user based on the swing data generated by said sensors, wherein the sound generator generates said auditory feedback based on said swing data during a swing of the apparatus and prior to striking the object with the strike face to provide guidance to the user prior to striking the object.

2. The swing feedback device according to claim 1, wherein said body is only pivotable about said pivot axis during initial attachment of said body to said apparatus.

3. The swing feedback device according to claim 1, wherein said swing data and/or said auditory feedback are generated in real time.

4. The swing feedback device according to claim 1, wherein during attachment of said body to said apparatus, said body is pivotally aligned within a predefined tolerance angle range about a plane extending perpendicular to said strike face.

5. The swing feedback device according to claim 4, wherein said predefined tolerance angle range comprises a deviation of up to 45 degrees either side of said plane.

6. The swing feedback device according to claim 1, further including an analysis module adapted for processing said swing data from said one or more sensors to perform one or more of the following:

i) generate, based on said swing data, audio data representing an audio signal for said sound generator;

ii) generate, based on said swing data, audio data representing an audio signal for a line out component;

iii) generate, based on said swing data, audio data representing an audio signal for an external sound generator remote from said device;

iv) generate results data, including said swing data and other ancillary data representing one or more of a date, time, practice session identifier, device sensitivity, rank, score and rating, and store the results data into a data store; and v) generate, based on said swing data, control data for manipulating the position, movement or other characteristics a user interface component displayed to a user via a display.

7. A swing feedback device according to claim 6, wherein said swing data is provided to said analysis module by at least one of a wired or wireless communication link.

8. A swing feedback device according to claim 6, wherein said sound generator receives said audio signal from said analysis module and generates said auditory feedback for said user based upon said audio signal.

9. A swing feedback device according to claim 6, wherein said analysis module and/or said sound generator are located within said body.

10. A swing feedback device according to claim 6, wherein said analysis module is located external to said body, and receives data from said sensors by a wireless communication link.

11. A swing feedback device according to claim 6, wherein said feedback includes at least one of:

i) producing sound of a predefined pitch when said offset angle is within a predetermined response angle range, and not producing sound when said offset angle is not within said predetermined response angle range;

ii) producing sound of a predefined pitch when the offset angle is not within a predetermined response angle range, and not produce sound when the offset angle is within the predetermined response angle range;

iii) producing sound of varying pitch based on changes in said offset angle within said predetermined response angle range;

iv) producing sound of varying pitch based on changes in the offset angle when outside of the predetermined response angle range; or v) producing sound of different intensity based on a swing velocity of said apparatus moving with said body along said swing path.

12. A swing feedback device according to claim 11, wherein said predetermined response angle range is adjustable by a user.

13. A swing feedback device according to claim 1, wherein said swing data also includes one or more of:

i) data representing a swing velocity of said apparatus moving with said body along said swing path;

ii) data representing a position on said strike face that is impacted by said object during said swing path;

iii) data representing a swing plane angle of the apparatus during said swing path; or iv) data representing swing frequency of the apparatus.

14. A swing feedback device according to claim 1, wherein said sensors include one or more of optical sensors, magnetic sensors, shaft encoders, linear position sensors, displacement sensors, accelerometers, gyroscopes, and tilt switches.

15. A sporting apparatus for use by a user in a sporting activity including a device as claimed in claim 1.

16. The sporting apparatus according to claim 15, wherein said device is integrally formed with said apparatus.

17. A swing feedback device, including:

(a) a body attachable to an apparatus, said apparatus having a strike face moveable by a user along a swing path for striking an object, said body being attachable to a support portion of said apparatus and aligned within a predefined tolerance angle range about a plane extending perpendicular to said strike face;

(b) one or more sensors attached to said body, said sensors being adapted to generate swing data including an offset angle formed between said strike face and said swing path during travel of said strike face along said swing path; and (c) a sound generator for generating auditory feedback for said user based on the swing data generated by said sensors, wherein the sound generator generates said auditory feedback based on said swing data during a swing of the apparatus and prior to striking the object with the strike face to provide guidance to the user prior to striking the object.

18. The swing feedback device according to claim 17, wherein said body is only pivotable about said pivot axis during initial attachment of said body to said apparatus.

19. The swing feedback device according to claim 17, wherein said swing data and said auditory feedback are generated in real time.

20. A swing feedback device, including:

(a) a body moveable relative to an apparatus, said apparatus having a strike face moveable by a user along a swing path for striking an object, said body being pivotable about a pivot axis for alignment relative to said swing path;

(b) one or more sensors attached to said body, said sensors for generating swing data including an offset angle formed between said strike face and said swing path during travel of said strike face along said swing path; and (c) a sound generator for generating auditory feedback for said user based on the swing data generated by said sensors, wherein the sound generator generates said auditory feedback based on said swing data during a swing of the apparatus and prior to striking the object with the strike face to provide guidance to the user prior to striking the object.

* * * * *